United States Patent [19]

Matsumoto

[11] Patent Number: 5,025,701

[45] Date of Patent: Jun. 25, 1991

[54] SOUND SOURCE APPARATUS

[75] Inventor: Naoaki Matsumoto, Tachikawa, Japan

[73] Assignee: Casio Computer Co., Ltd., Tokyo, Japan

[21] Appl. No.: 431,738

[22] Filed: Nov. 3, 1989

[30] Foreign Application Priority Data

Nov. 8, 1988 [JP] Japan ..... 63-281642
Nov. 8, 1988 [JP] Japan ..... 63-281643

[51] Int. Cl.[5] ..... G10H 1/18; G10H 1/26

[52] U.S. Cl. ..... 84/615; 84/645; 84/653

[58] Field of Search ..... 84/600–607, 84/615, 617, 645, 653, 655

[56] References Cited

U.S. PATENT DOCUMENTS 4,184,400 1/1980 Niimi ..... 84/645 X
4,711,148 12/1987 Takeda et al. ..... 84/653

*Primary Examiner*—William M. Shoop, Jr.
*Assistant Examiner*—Brian Sircus
*Attorney, Agent, or Firm*—Frishauf, Holtz, Goodman & Woodward

[57] ABSTRACT

A plurality of sound source apparatuses are mutually connected so as to function as if they are a single sound source apparatus. The number of polyphonic channels is increased in accordance with the number of sound source apparatuses connected. In connecting these apparatuses, it is necessary to designate a polyphonic channel region in use for each sound source apparatus. The region may be set by specifying the upper and lower limits of polyphonic channels of setting a machine number of each sound source appartaus. Alternatively, the region may be automatically set.

12 Claims, 27 Drawing Sheets

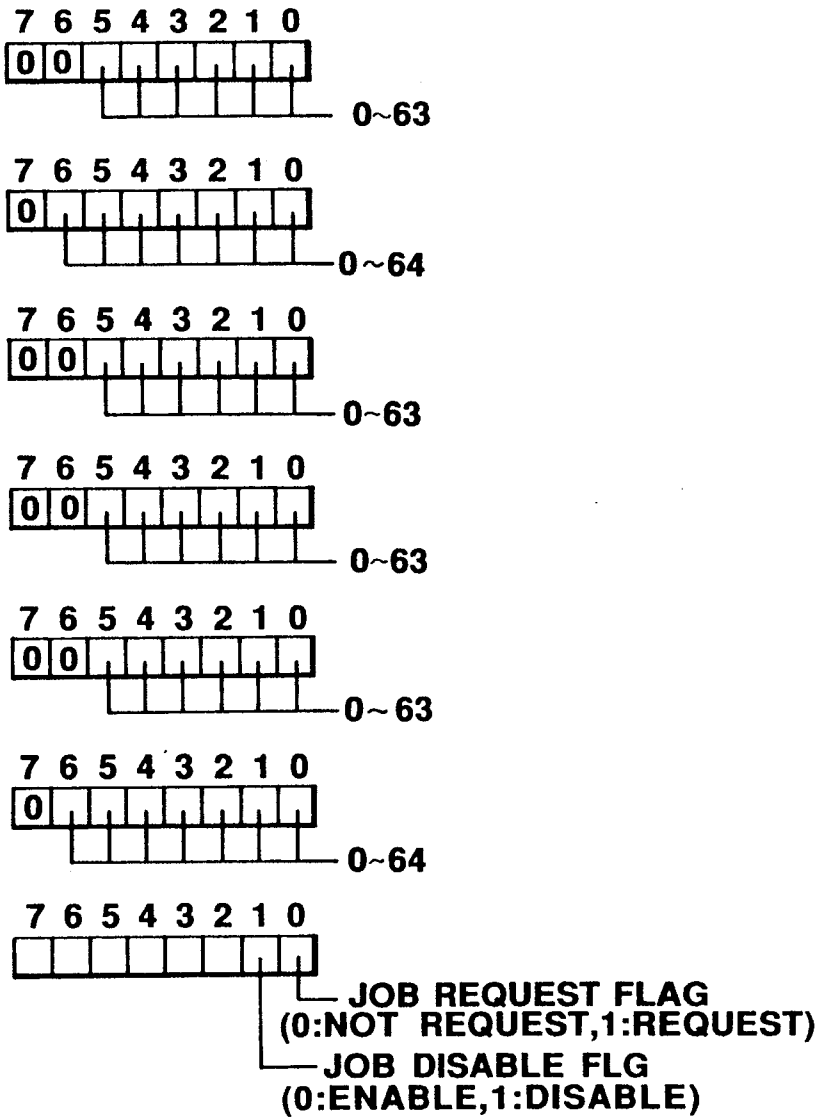
FIG.10B OFF POINTER
FIG.10C EMPTY COUNTER
FIG.10D ON POINTER
FIG.10E JOB RANGE LOWER POINTER
FIG.10F JOB RANGE UPPER POINTER
FIG.10G NOTE ON COUNTER
FIG.10H FLAG

SOUND SOURCE APPARATUS

BACKGROUND OF THE INVENTION

1. Field of the Invention

The present invention relates to sound source apparatuses capable of generating a musical tone based on note data (musical tone data) received from an external device, and, more particularly, to sound source apparatuses which, when a plurality of sound source apparatuses are mutually connected, can cooperatively function as a single sound source apparatus.

2. Description of the Related Art

Due to appearance of a MIDI (Musical Instrument Digital Interface) system and development of an electronic musical instrument employing a digital signal processing, it is possible to mutually connect a plurality of electronic musical instruments via a MIDI and play a music synchronizing them. Particularly, many electronic musical instruments of sound source module type excluding a music-playing section such as a keyboard, have been developed for the purpose of such a synchronous performance. With a plurality of sound source modules of this type mutually connected, a high performance effect can be attained.

The above sound source module is connected with an external keyboard or the like and receives MIDI data such as NOTE ON data (tone generation instruction data) or NOTE OFF data (note off instruction data) therefrom to thereby perform tone generation control such as generation of a musical tone (note on) or note off. In this case, a single sound source module can normally generate a plurality of musical tones in parallel through time-divisional processing and typically has about 8 to 16 polyphonic channels. With a plurality of such sound source modules being mutually connected via a MIDI, these modules can perform synchronous musical performance when independently receiving MIDI data. In this case, sound source modules each having 8 to 16 polyphonic channels perform tone generation independently and in parallel.

According to the above prior art, however, a plurality of sound source modules simply execute a musical performance in parallel. Functions of these sound source modules cannot be expanded, nor can they be used as a single sound source module. This problem may be overcome by permitting expansion of a sound source by specifying a tone region in use for each sound source module and determining the presence or absence of a musical tone being generated according to a note No. (number specifying a pitch) entered externally. In this type, a sound source module which generates a musical tone is determined by the tone region of a musical performance, so that using a certain tone region many times, the number of polyphonic tones involved may exceed the number of polyphonic tones allowed per sound source module. This makes further tone generation impossible in spite of remaining polyphonic channels to be able to generate tones, and narrows or limits the range of flexibility or freedom of a musical performance.

SUMMARY OF THE INVENTION

Accordingly, it is an object of this invention to permit an increase in the number of polyphonic tones to be generated in accordance with the number of connected sound sources by connecting a plurality of sound sources, and, more particularly, to permit the number of independent polyphonic tones to be set for each sound source, thereby allowing for expansion of polyphonic tones in use by making the best use of the characteristic of each sound source.

The first aspect of the present invention is premised on a sound source apparatus capable of receiving note data from an external unit and controlling tone generation based on this note data. In this case, individual sound source apparatuses are mutually connected by, for example, a MIDI. The apparatuses may be designed in such a way that one of them is equipped with a music-playing section such as a keyboard, and controls its own sound source as well as a sound source module externally connected on the basis of note data output from the music-playing section through a musical operation conducted there.

This sound source apparatus includes polyphonic region designating means for specifying, in a first polyphonic region having a plurality of polyphonic channels, a second polyphonic region included in the first polyphonic region, by specifying upper and lower limits thereof. The polyphonic channels mean a plurality of tone generating channels for ensuring simultaneous generation of musical tones at a plurality of pitches. For instance, with a maximum of 64 polyphonic tones (number of simultaneously generatable tones), the first polyphonic region ranges from the first channel to the 64th channel. The second polyphonic region ranges from the 9th channel to the 16th channel, for example. In this example, the polyphohic region designating means is a combination of a cursor switch and a display device such as an LCD (Liquid Crystal Display), which can designate the second polyphonic region by specifying the lower limit "9" and the upper limit "16."

The above sound source apparatus also has note data memory means for storing note data for each polyphonic channel in the first polyphonic region, in an associated area. This means is a memory capable of storing note data including data representing a note number, code data representing note off in progress or other data, at addresses associated with, for example, the 1st to 64th channels.

This sound source apparatus further has polyphonic channel control means for, when receiving note data, updating note data of the polyphonic channels in the first polyphonic region, stored in the note data memory means, in accordance with a predetermined rule. This means, when receiving NOTE ON data, for example, performs such a control as to save note number data to be subjected to a note-on operation, at those of the addresses associated with the NOTE SAVE memory 1st to 64th channels whose corresponding channels are currently empty (available) or currently subjected to a note-off operation, from younger addresses in order. When receiving NOTE OFF data, for example, this means performs such a control as to change those of the note number data stored at the individual addresses which coincide with the note number data to be subjected to a note-off operation, to code data representing a note-off operation in progress. The control means may be designated to control the memory contents in the above manner, in accordance with note data instructing a pitch change (bend instruction) or a change of various tone effects.

The sound source apparatus also includes tone control means for controlling generation of a musical tone based on note data of each polyphonic channel stored in those areas of the note data memory means which are associated with the second polyphonic region. When note number data is stored in any of those of the addresses associated with the NOTE SAVE memory 1st to 64th channels which are associated with the 9th to 16th channels, for example, and are designated to the sound source module of this apparatus, this means starts tone generation with that note number. When code data representing note off in progress is stored instead, a musical tone currently being generated which corresponds to the note number data that has been stored there up to now, is subjected to note off.

With the above structure, the tone control means may be designed to perform tone control selecting between a mode for controlling generation of a musical tone based on note data stored in each polyphonic channel in the second polyphonic region in the note data memory means and a mode for controlling tone generation based on the received note data without any condition.

The second aspect of the present invention is premised on a sound source apparatus capable of receiving note data from an external unit and controlling tone generation based on this note data. In this case, individual sound source apparatuses are mutually connected by, for example, a MIDI. The apparatuses may be designed in such a way that one of them is equipped with a music-playing section such as a keyboard, and controls its own sound source as well as a sound source module externally connected on the basis of note data output from the music-playing section through a musical operation conducted there.

This sound source apparatus has polyphonic region designating means for specifying, in a first polyphonic region having a plurality of polyphonic channels, a second polyphonic region included in the first polyphonic region, by specifying machine numbers. With a maximum of 64 polyphonic tones allowed, for example, when a machine No. "1" is specified, this means specifies the second polyphonic region of 1st to 8th channels. When a machine No. "2" is specified, this means specifies the second polyphonic region of 9th to 16th channels. That is, the polyphonic region designating means can automatically specify the second polyphonic region simply by the machine No. input. This means may be arithmetic operation means for computing the upper and lower limits of the second polyphonic region from the specified machine No.

The above sound source apparatus also has note data memory means for storing note data for each polyphonic channel in the first polyphonic region, in an associated area. This means is a memory capable of storing note number data, code data representing note off in progress or other data, at addresses associated with, for example, the 1st to 64th channels.

This sound source apparatus further has polyphonic channel control means for, when receiving note data, updating note data of the polyphonic channels in the first polyphonic region, stored in the note data memory means, in accordance with a predetermined rule. This means, when receiving NOTE ON data, for example, performs such a control as to save note number data to be subjected to a note-on operation, at those of the addresses associated with the NOTE SAVE memory 1st to 64th channels whose corresponding channels are currently empty (available) or currently subjected to a note-off operation, from younger addresses in order. When receiving NOTE OFF data, for example, this means performs such a control as to change those of the note numbers stored at the individual addresses which coincide with the note numbers to be subjected to a note-off operation, to code data representing a note-off operation in progress. The control means may be designated to control the memory contents in the above manner, in accordance with note data instructing a pitch change (bend instruction) or a change of various tone effects.

The sound source apparatus also includes tone control means for controlling generation of a musical tone based on note data of each polyphonic channel stored in those areas of the note data memory means which are associated with the second polyphonic region. When note number data is stored in any of those of the addresses associated with the NOTE SAVE memory 1st to 64th channels which are associated with the 9th to 16th channels, for example, and are designated to the sound source module of this apparatus, this means starts tone generation with that tone number. When code data representing note off in progress is stored instead, a musical tone currently being generated which corresponds to the note number data that has been stored there up to now, is subjected to note off.

With the above structure, the tone control means may be designed to perform tone control selecting between a mode for controlling generation of a musical tone based on note data stored in each polyphonic channel in the second polyphonic region in the note data memory means and a mode for controlling tone generation based on the received note data without any condition.

The sound source apparatus may be equipped with a keyboard so that it can generate a musical tone independent of externally supplied note data.

BRIEF DESCRIPTION OF THE DRAWINGS

FIGS. 10A through 10H are diagrams illustrating the configuration of number-of-tone assign control memory;

DETAILED DESCRIPTION OF THE PREFERRED EMBODIMENTS

First Embodiment

Figure 1:
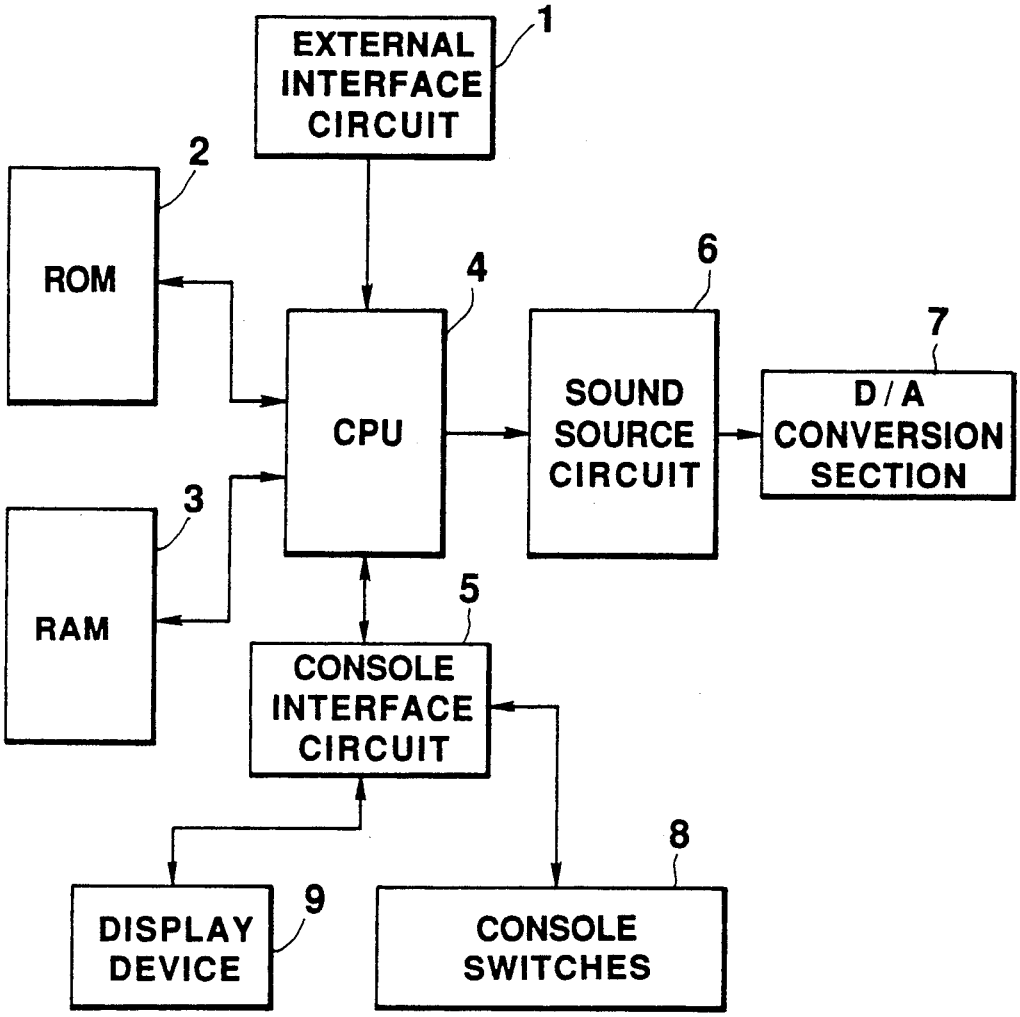
FIG. 1 is a diagram illustrating the general structure of the first embodiment of the present invention.

FIG. 1 is a diagram of the general structure of the first embodiment of the present invention. This embodiment is realized as an electronic musical instrument of a sound source module type which receives MIDI data from an external unit and generates a musical tone based on the data. This apparatus is naturally equipped with no music-playing section such as a keyboard. Therefore, such a music-playing section is externally coupled via a MIDI. If NOTE ON data and NOTE OFF data can be input as MIDI data from an external unit, however, the embodiment may be realized as an ordinary electronic musical instrument having a keyboard or the like.

Referring to FIG. 1, an external input interface circuit 1 serves to receive MIDI data that is a serial digital signal.

A CPU 4 executes various operation flowcharts to be described later, in accordance with a program stored in a ROM 2 using a RAM 3 as a data memory. The CPU 4 receives MIDI data from the external input interface circuit 1, receives ON/OFF statuses of individual console switches 8 via a console interface circuit 5, controls a display device 9, and performs a control for tone generation based on these processes. The display device 9 is constituted by an LCD.

A sound source circuit 6 is a tone generator capable of generating eight tones simultaneously. This circuit 6 executes a tone generating process in octotime-divisional manner corresponding to eight tones, based on control processes associated with tone generation, such as the start/end of tone generation (NOTE ON/OFF), timbre setting and vibrato, and outputs a digital tone signal.

A D/A section 7 performs D/A conversion of the digital tone signal from the sound source circuit 6, filters it out by means of a low-pass filter, then outputs an analog tone signal. This analog tone signal is output to the outside of the main body of a sound source module, and is generated as a musical sound via an external amplifier and an external loudspeaker or headphone.

BRIEF OPERATION OF FIRST EMBODIMENT

According to the first embodiment, a plurality of electronic musical instruments of a sound source module type each of which is structured as illustrated in FIG. 1, which generate a musical tone based on musical tone data externally received, are mutually connected via a MIDI, an exclusive interface for musical tone data transfer, and these modules are used as a single electronic musical instrument. In general, a single sound source module is capable of simultaneously generating about eight polyphonic tones. According to the prior art, even if a plurality of sound source modules of this type are mutually connected, eight polyphonic tones are generated in superimposed manner by the number of the modules or if musical tones are concentrated on a certain tone region, some musical tones may not be sounded. According to this embodiment, if two 8-tone polyphonic type sound source modules are connected, they can be used as a 16-tone single musical instrument. A maximum of 8 sound source modules can be mutually connected, thus realizing a 64-tone polyphonic.

Accordingly, a poly No. is defined within a maximum range of 8 polyphonic tones per one sound source module having the structure shown in FIG. 1. For instance, a player can assign poly Nos. 1 to 8 to the first sound source module, and poly Nos. 9 to 16 to the second sound source module. In this example, if the player starts playing a music using an external keyboard or the like and NOTE ON data (tone generation start data) based on the key-depressing operation is sequentially input via a MIDI to the first and second sound source modules, musical tones with note Nos. (note numbers) indicated by individual pieces of NOTE ON data from the first to eighth tones associated with simultaneously depressed keys are generated from the first sound source module. When individual NOTE ON data of 9th to 16th tones associated with simultaneously depressed keys are input, musical tones with the associated note Nos. are generated from the second sound source module. When any of the presently-depressed keys is released during this process and associated NOTE OFF data (note off instruction data) is entered, generation of a musical tone with the poly No. assigned with the note No. indicated by that data will be stopped. Thereafter, when new NOTE ON data is input, it is assigned to the youngest one of presently empty or available poly Nos., and a musical tone associated with that data will be generated from the sound source module to which that poly No. is assigned.

All of the mutually connected sound source modules execute the above operation synchronously, so that the player can produce musical tones with the desired number of polyphonic channels by mutually connecting the desired number of sound source modules. For this purpose, the RAM 3 of each sound source module having the structure shown in FIG. 1 has a table called a NOTE SAVE memory for storing a status associated with the poly No. assigned to the sound source module as well as statuses associated with the poly Nos. assigned to all the other sound source modules, and the contents of the individual tables are updated by the respective sound source modules in complete synchronism with each other in accordance with a given rule, every time each NOTE ON or NOTE OFF data is input. This is an important characteristic of the first embodiment.

In the following description, the operation of one sound source module with the structure shown in FIG. 1 to realize the above-described operation will be explained in detail. According to the first embodiment, it is possible to select for each sound source module between a mode for executing the above polyphonic synchronous operation and a mode for functioning independent of the other sound source modules as in the conventional case. The former mode is called a poly synchronous ENABLE mode, and the latter a poly synchronous DISABLE mode.

DETAILED OPERATION OF FIRST EMBODIMENT

Figure 2A:
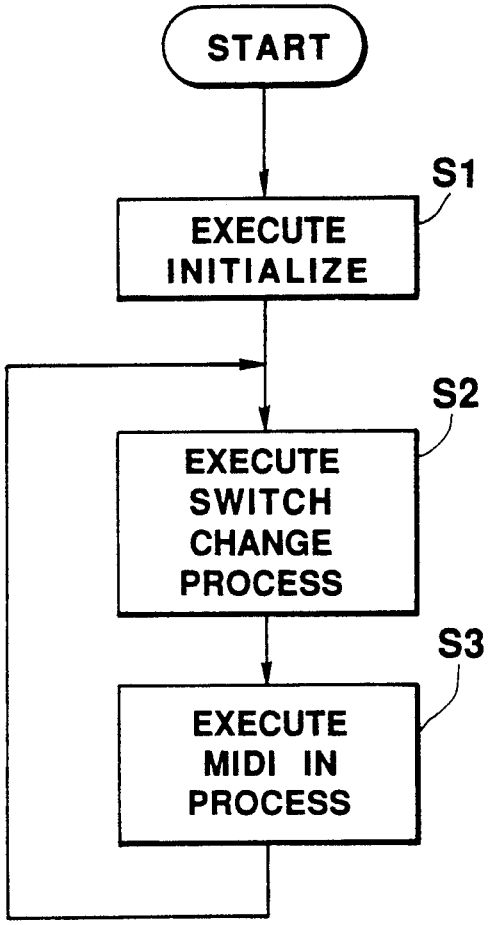
FIGS. 2A and 2B illustrate a main operation flowchart.
Figure 2B:
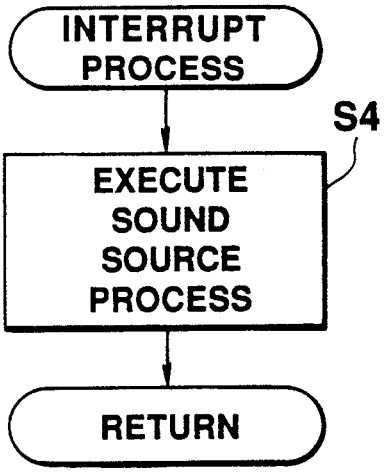

The operation of the first embodiment having the above-described structure will now be explained. FIGS. 2A and 2B illustrate a main operational flowchart of the first embodiment.

To begin with, when a power switch (not shown) is turned ON, an initialization process is executed in S1. This process includes initialization of the contents of the RAM 3 in FIG. 1, resetting of the sound source circuit 6, setting of a timbre, etc.

Tone generation control is executed by repeating a switch change process in S2 and a MIDI IN process in S3 (both will be described later).

In the meantime, an interrupt occurs at given intervals, and a control process for the sound source circuit 6 in FIG. 1 is executed in S4. This process, not directly relevant to the present invention, serves to add a vibrato effect to a musical tone signal to be generated by the sound source circuit 6. Since this effect gives vibration to the pitch of a musical tone at given intervals, it is controlled by the interruption conducted at given intervals as explained above.

Figure 3:
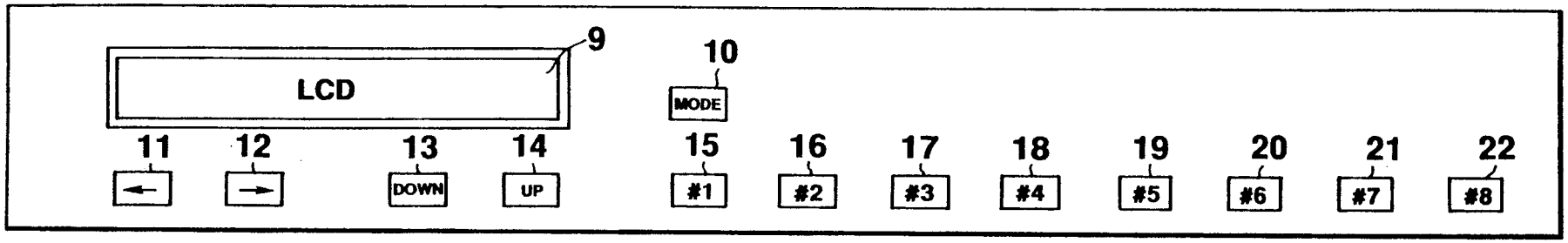
FIG. 3 is an external view of console switches and a display device.

FIG. 3 is an external view of the console switches 8 and display device 9. Referring to this diagram, "LCD 9" is the display device 9 in FIG. 1. The other portions denoted by numerals 10–22 correspond to the console switch 8 in FIG. 1. A mode setting switch (MODE) 10 serves to set a mode for parameters that are displayed by the LCD 9. (This mode setting will be described later.) One of plural pieces of data displayed on the LCD 9 is selected using cursor switches 11 and 12, and the selected data is updated using an UP switch 14 and a DOWN switch 13. Further, the timbre of a musical tone to be generated is selected using switches 15–22 to which #1 to #8 are affixed.

Figure 4:
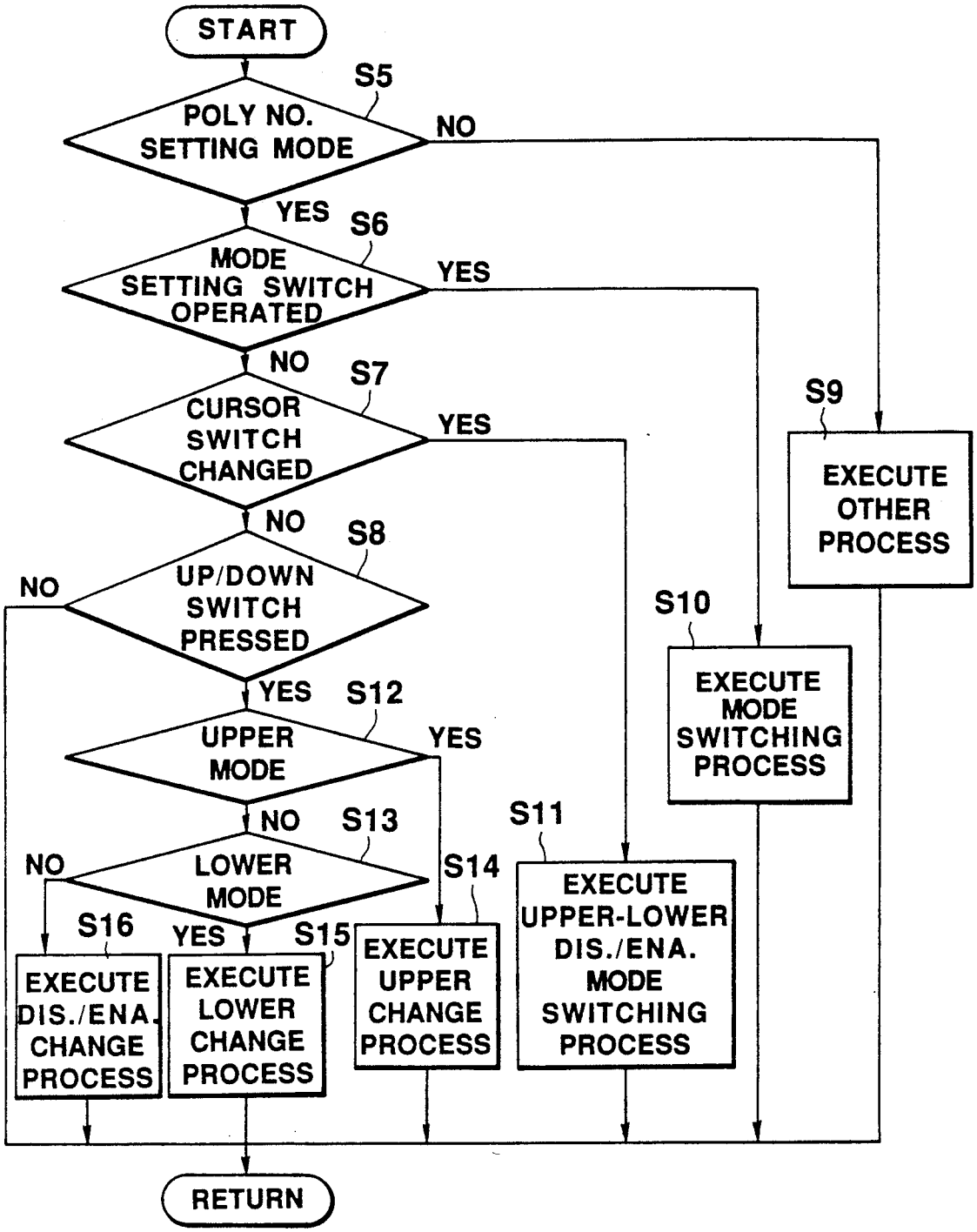
FIG. 4 is an operation flowchart for a switch change process.

FIG. 4 illustrates in detail the switch change process in S2 in FIG. 2A. This process is repeated as shown in FIG. 2A, to always monitor whether or not the individual switches 10 to 22 in FIG. 3 are switched over, and performs a process in mode associated with the changed switch.

In S5 it is discriminated whether or not it is a poly No. setting mode. The LCD 9 can display data of various modes such as data of timbre setting, data of effect setting and the like; the mode display i changed every time the mode setting switch 10 in FIG. 3 is pressed. Of the various modes, the poly No. setting mode is particularly relevant to the present invention. When a mode other than this poly No. setting mode is displayed, the switch change process is terminated after the displayed mode, e.g., setting/changing of the timbre using the switches 15–22 in FIG. 3 or setting/changing of the effect using an associated switch (not shown), is executed in S9.

When the poly No. setting mode is displayed, the flow advances to S6 where it is discriminated whether or not the mode is changed by operating the mode setting switch 10 (FIG. 3). If the decision is YES, the flow advances to S10 where the mode on the LCD 9 (FIG. 3) is changed from the present poly No. setting mode to the one selected by the operation of the mode setting switch 10, then the switch change process in S2 in FIG. 2A will be terminated. When the flow enters again to the switch change process in S2 in FIG. 2A after execution of the MIDI IN process in S3, the decision in S5 in FIG. 4 becomes NO and a process for a mode other than the poly No. setting mode is executed in S9, as described above. Though not illustrated, the step S9 has a processing flow similar to the branching from S6 to S10, so that when the mode becomes the poly No. setting mode by the operation of the mode setting switch 10, the decision in S5 becomes YES and the flow returns to the process of the poly No. setting mode.

Figure 5:
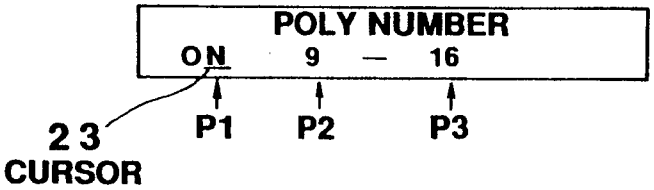
FIG. 5 is a diagram illustrating an example of setting the number of channels or tones to be generated as displayed on the display device.

If the decision is NO in S6, the flow advances to S7 where it is discriminated whether or not either console switch 11 or 12 (FIG. 3) is switched over. If the decision is YES, the flow advances to S11 where one of plural pieces of data displayed on the LCD 9 is selected. According to the first embodiment, the data on the LCD 9 in poly No. setting mode may be as illustrated in FIG. 5. This will be described below more specifically. As already described in "Brief Operation of First Embodiment," the sound source module according to the first embodiment can set a poly No. for each module and the range of that poly No. is indicated by the numeral shown at positions P2 and P3 of the LCD 9 in FIG. 5. The illustrated example indicates that poly Nos. 9 to 16 are assigned. The symbol "ON" at position P1 in FIG. 5 indicates that the associated sound source module is in poly synchronous ENABLE mode as described in "Brief Operation of First Embodiment." If this display is "OFF," it indicates the poly synchronous DISABLE mode. The statuses displayed at the individual positions P1 to P3 can be changed by operating the DOWN switch 13 and UP switch 14 (see FIG. 3), and the cursor switches 11 and 12 in FIG. 3 are used to select which one of the statuses at positions P1–P3 should be changed. More specifically, in FIG. 5 the cursor 23 is presently at position P1 so as to permit alteration of data at P1, but the cursor 23 can be moved to P2 or P3 by depressing the cursor switch 11 or 12, thereby permitting alteration of data at the position where the cursor 23 is moved. This cursor change process is executed in S11 in FIG. 4. After execution of the cursor change process, the switch change process in S2 in FIG. 2A is terminated.

If, after the above processing, the flow returns again to the switch change process in S2 through the MIDI IN process in S3, the decision in S7 becomes NO and it is discriminated in S8 whether or not the DOWN switch 13 or UP switch 14 has been depressed. If neither switch has been depressed, the decision in S8 becomes NO and the switch change process in S2 (FIG. 2A) will then be terminated.

When the DOWN or UP switch 13 or 14 has been depressed, on the other hand, if the cursor 23 is at P1 on the LCD 9 in FIG. 5, the decisions in S12 and S13 become NO and the DIS./ENA. change process in S16 will be executed. If the cursor 23 is at P2, the decision in S12 is NO and the decision in S13 is YES so that the LOWER change process in S15 will be executed. If he cursor 23 is at P3, the decision in S12 is YES and the UPPER change process S14 will be executed.

The above three processes will be described in order.

Figure 6:
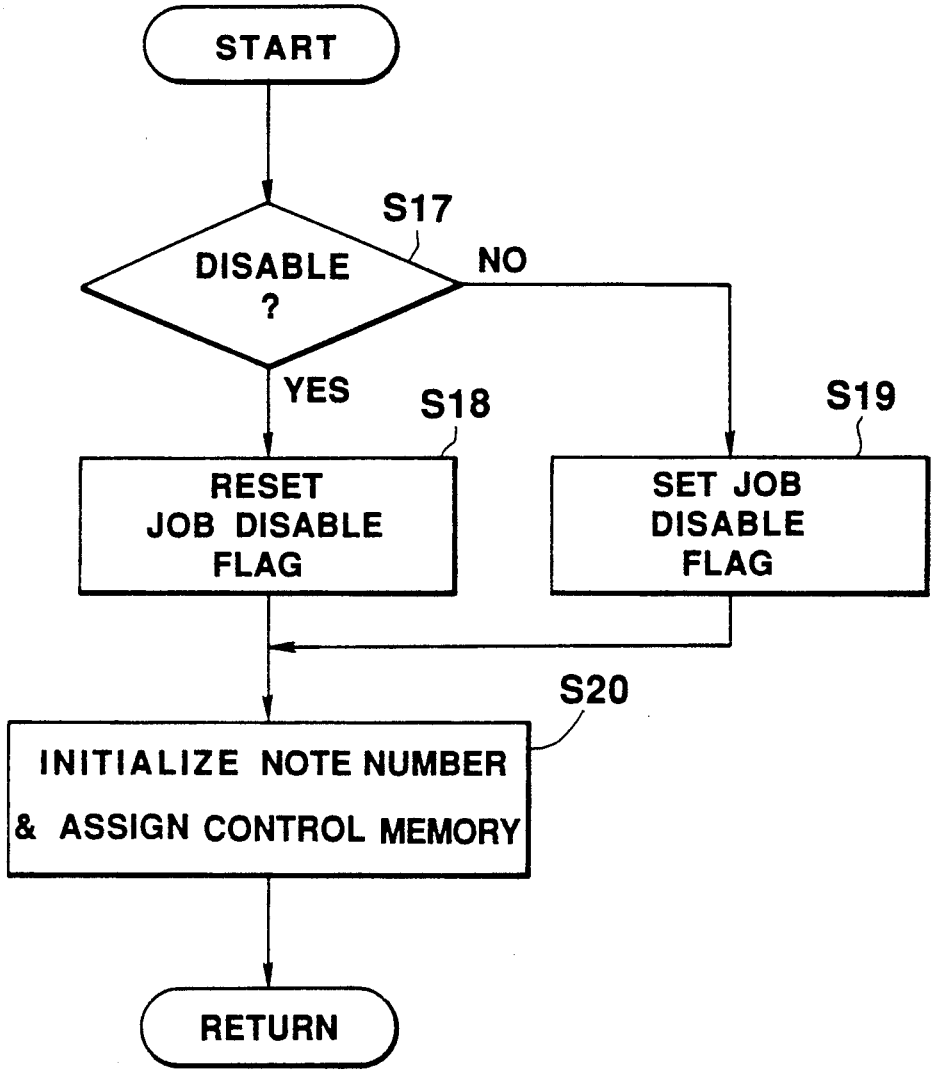
FIG. 6 is an operation flowchart for a DIS./ENA. change process.

First, the DIS./ENA. change process in S16 is to change the present mode of the sound source module to the poly synchronous ENABLE or DISABLE mode through operation of the DOWN switch 13 or UP switch 14, as described earlier. FIG. 6 illustrates in detail the process in S16 in FIG. 4.

In S17 it is discriminated whether the present mode is the poly synchronous DISABLE mode or ENABLE mode.

If it is the DISABLE mode, i.e., if the display at P1 in FIG. 5 is "OFF," the decision in S17 is YES and a JOB DISABLE flag is reset in S18. This flag, whose detailed description will be given later, is for setting either the DISABLE mode or ENABLE mode, and is provided in a note No. assign control memory (see FIGS. 10A-10H) constituted in the RAM 3 in FIG. 1. When reset in S18, this flag is changed for the ENABLE mode. At the same time, the display at P1 in FIG. 5 is changed to "ON."

If the present mode is the ENABLE mode, i.e., if the display at P1 in FIG. 5 is "ON," the decision in S17 becomes NO and the JOB DISABLE flag is set in S19, thus changing the mode to the DISABLE mode. At the same time, the display at P1 in FIG. 5 is changed to "OFF."

Each of S18 and S19 is executed by operation of either the DOWN switch 13 or UP switch 14; in this respect, there is no distinction between the DOWN and UP switches.

After execution of step S18 or S19, each pointer, counter, flag and NOTE SAVE memory of the note No. assign control memory (see FIGS. 10A-10H) constituted in the RAM 3 in FIG. 1 are initialized (or cleared to 0) to stop generation of all musical tones presently being generated in S20. This memory will be described later.

Upon execution of the operational sequence in FIG. 6 (the DIS./ENA. change process in S16 in FIG. 4), the switch change process in S2 in FIG. 2A will be terminated.

Figure 7:
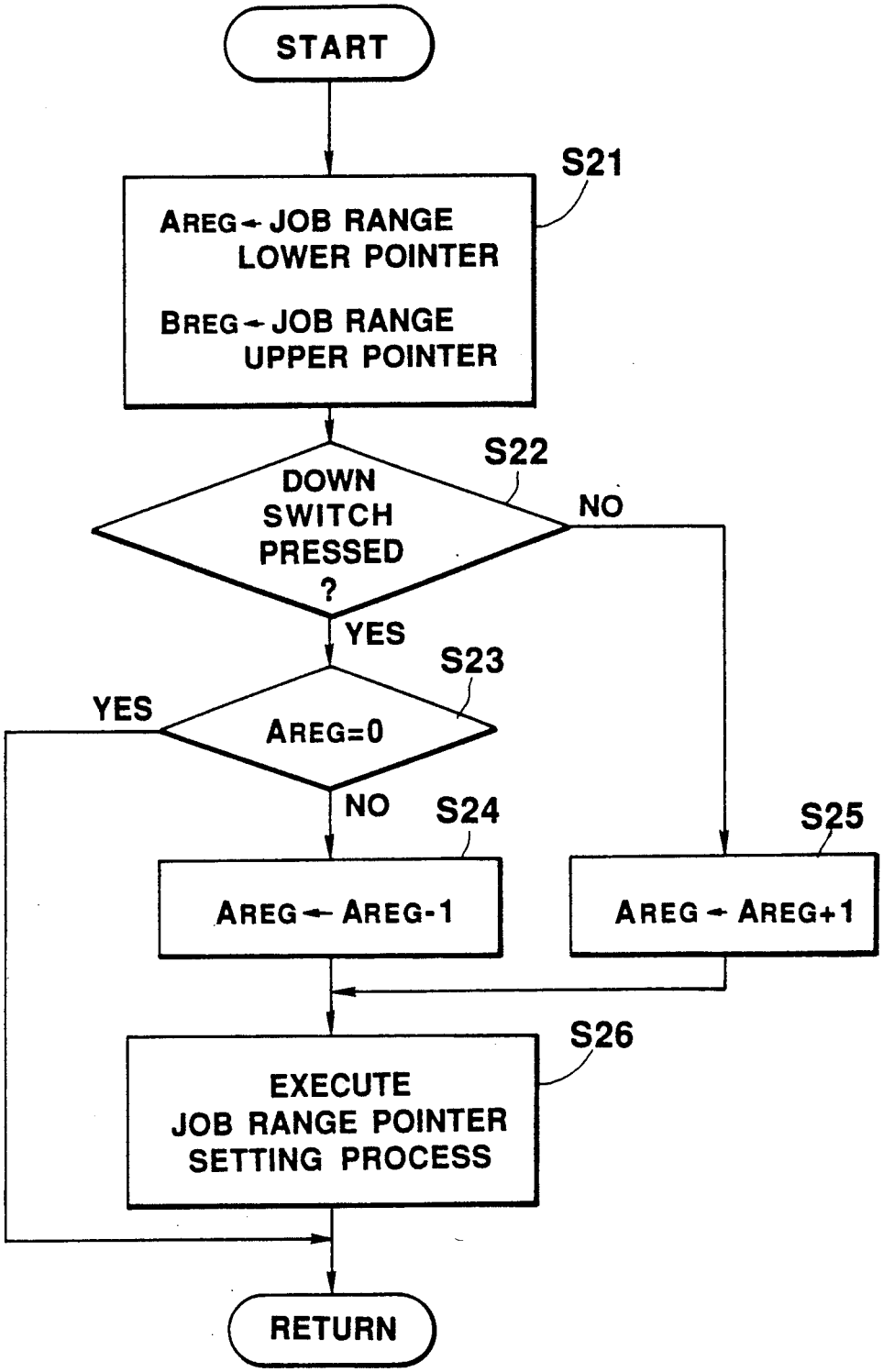
FIG. 7 is an operation flowchart for a LOWER change process.

The LOWER change process in S15 in FIG. 4, as described earlier, is for changing the lower limit of the range of the poly No. presently set in the sound source module by operation of the DOWN switch 13 or UP switch 14 shown in FIG. 3. FIG. 7 presents a detailed illustration of S15 in FIG. 4.

First, the value of a JOB RANGE LOWER pointer is loaded into a register $A_{REG}$ and the value of a JOB RANGE UPPER pointer is loaded into a register $B_{REG}$. The JOB RANGE LOWER and JOB RANGE UPPER pointers, which will be described in detail later, are for setting the lower and upper limits of a poly No. and are provided in the note No. assign control memory (see FIGS. 10A-10H) provided in the RAM 3 (FIG. 1). The registers $A_{REG}$ and $B_{REG}$ are provided in the CPU 4 in FIG. 1. Values obtained by subtracting 1 from the lower and upper limits respectively at P2 and P3 on the LCD 9 (see FIG. 5) are set in the individual pointers and registers.

Following S21, it is discriminated in S22 whether or not the DOWN switch 13 has been switched over. In this case, since it has already been discriminated in S8 in FIG. 4 that either the DOWN switch 13 or UP switch 14 was depressed, if the decision in S22 is YES, the DOWN switch 13 has been depressed and if the decision is NO, the UP switch 14 has been depressed.

If the DOWN switch 13 has been depressed and the decision in S22 is YES, it is discriminated in S23 whether or not the value in the register $A_{REG}$ is 0. As described in "Brief Operation of First Embodiment," the minimum value designatable as a poly No. is "1," and "0" which is less than this value by 1 is the minimum value in the register $A_{REG}$. If the value in the register $A_{REG}$ is "0," therefore, since the value cannot be set lower than "0," the decision in S23 becomes YES and the LOWER change process in S15 in FIG. 4 will be terminated without performing a further process. If the value in the register $A_{REG}$ is not "0," it is decremented by 1. As described earlier, the value of the register $A_{REG}$ corresponds to the poly No. 1 on the LCD 9 in FIG. 5.

If the UP switch 14 has been depressed and the decision in S22 is NO, the value of the register $A_{REG}$ is incremented by 1 in S25.

Figure 9:
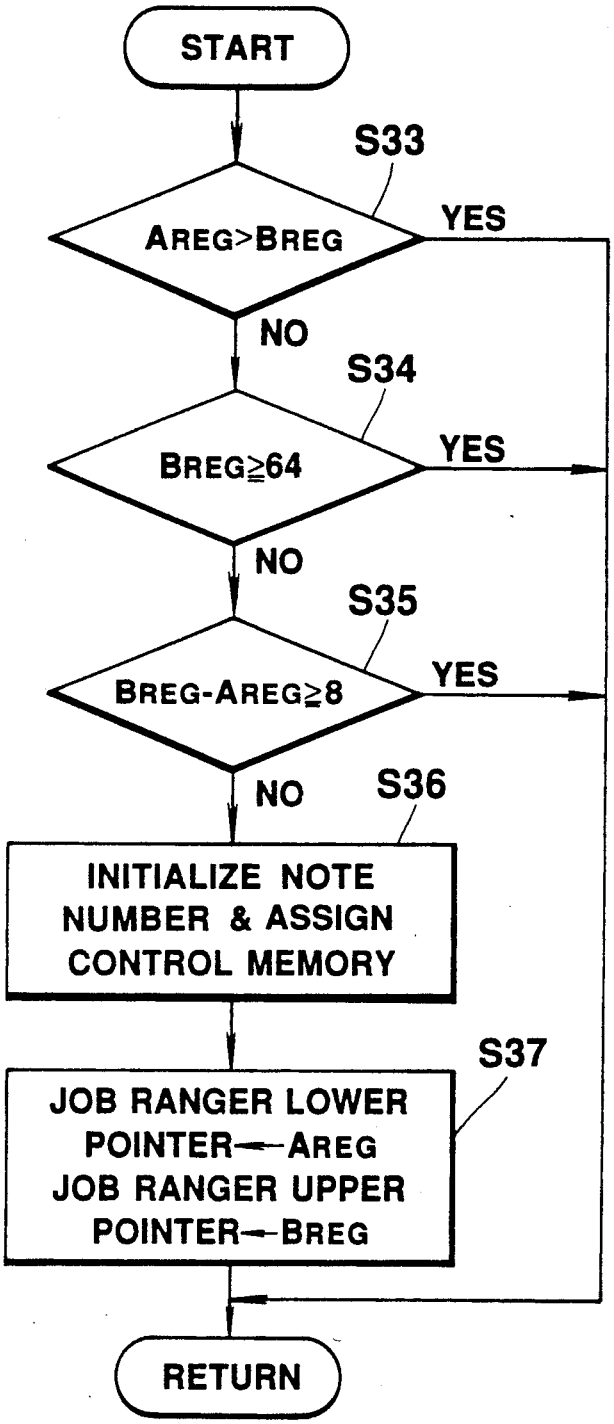
FIG. 9 is an operation flowchart for a process for setting a JOB RANGE pointer.

After execution of the process in S24 or S25, the flow advances to S26 for setting the JOB RANGE pointer. FIG. 9 presents a detailed illustration of this process.

In S33, it is discriminated whether or not the value in the register $A_{REG}$ exceeds the value in the register $B_{REG}$. As described earlier (see S21 in FIG. 7), since the value of the upper limit of the poly No. is held in the register $B_{REG}$, a check is made so that the lower limit of the poly No. in the register $A_{REG}$ to be updated does not exceed the upper limit. If the decision is YES in S33, the process of S26 in FIG. 7 is terminated without a further process, the value of the register $A_{REG}$ updated in S24 or S25 is rendered invalid, and the process of S15 in FIG. 4 will be terminated without changing the value of the JOB RANGE UPPER pointer. If the decision is NO in S33 in FIG. 9, the flow advances to S34. Since the value of the register $B_{REG}$ is not changed in the LOWER change process, the decision in S34 becomes NO (this process will be described later) and the flow advances to S35. In this step, it is discriminated whether or not the difference between the upper limit of the poly No. in the register $B_{REG}$ and the lower limit of the poly No. in the register $A_{REG}$ is equal to or greater than 8. According to the first embodiment, as the number of polyphonic tones generatable by a single sound source module is 8, a check is made in S35 so that the difference between the upper and lower limits does not exceed 8. If the decision is YES in S35, the process of S26 in FIG. 7 will be terminated without a further process and the process of S15 in FIG. 4 will be terminated as in the case of S33.

If the decision is NO in S35, the individual pointers, etc. of the note No. assign control memory (see FIGS. 10A-10H) constituted in the RAM 3 (FIG. 1) are initialized and generation of all of musical tones being presently generated is stopped in the subsequent step S36, as in the case of S20 in FIG. 6.

Subsequently, in S37 the content of the register $A_{REG}$ is saved in the JOB RANGE LOWER pointer and the content of the register $B_{REG}$ is saved in the JOB RANGE UPPER pointer. As the content of the JOB RANGE LOWER pointer is changed, the display at P2 in FIG. 5 is changed.

Through the above processes, the process of S26 in FIG. 7 will be terminated, thus completing the LOWER change process of S15 in FIG. 4. The above sequence of processes is executed upon depressing of the DOWN switch 13 or UP switch 14 (FIG. 3) once.

When either switch is further depressed, the sequence is executed once every time S2 is performed by repeating the loop of S2 and S3 (FIG. 2A).

Figure 8:
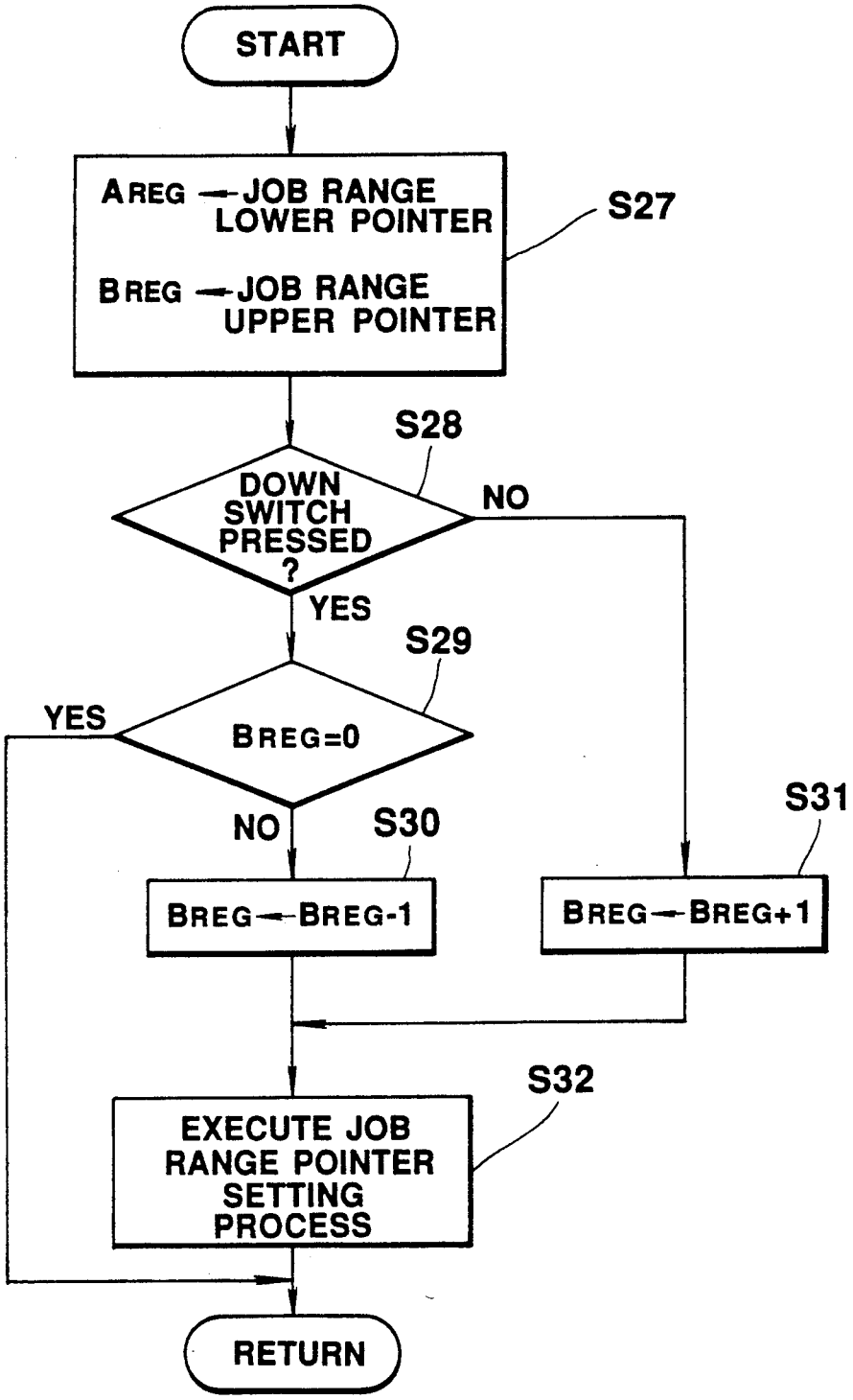
FIG. 8 is an operation flowchart for an UPPER change process.

The UPPER change process in S14 in FIG. 4, as described earlier, is for changing the upper limit of the range of the poly No. presently set in the sound source module by operation of the DOWN switch 13 or UP switch 14 shown in FIG. 3. FIG. 8 presents a detailed illustration of S16 in FIG. 4. The sequence of processes of S27–S32 is the same as that of S21–S26 in FIG. 7, which correspond to S15 in FIG. 4, except that the target for the former process sequence is the content of the register $B_{REG}$ associated with the lower limit of the poly No. whereas the target for the latter sequence is the content of the register $A_{REG}$ associated with the upper limit of the poly No.

More specifically, the content of the register $B_{REG}$ to which the content of the JOB RANGE UPPER pointer has been loaded is incremented or decremented by 1 in accordance with the operation of the DOWN switch 13 or UP switch 14, and it is checked if the content of the register $B_{REG}$ updated in S33–S35 in FIG. 9 corresponding to S32 coincides with the content of the register $A_{REG}$.

It is discriminated in S34 in FIG. 9 whether or not the value in the register $B_{REG}$ is equal to or greater than 64. As described in "Brief Operation of First Embodiment," the maximum value designatable as a poly No. is "64," and "63" which is less than this value by 1 is the maximum value in the register $B_{REG}$. If the value in the register $B_{REG}$ is equal to or greater than "64," therefore, the setting will be rendered invalid and the decision in S34 becomes YES. Then, the process in S32 in FIG. 8 will be terminated and the UPPER change process in S14 in FIG. 4 will be terminated without performing a further process.

If checks in S33–S35 are all passed, the individual pointers, etc. of the note No. assign control memory are initialized and generation of musical tones being presently generated is stopped in S36. In S37 the content of the register $A_{REG}$ is saved in the JOB RANGE LOWER pointer and the content of the register $B_{REG}$ is saved in the JOB RANGE UPPER pointer. As the content of the JOB RANGE UPPER pointer is changed, the display at P3 in FIG. 5 is changed.

Through the above processes, the process of S32 in FIG. 8 will be terminated, thus completing the UPPER change process of S14 in FIG. 4.

As described above, when the cursor switches 11 and 12 (FIG. 3) are operated, the cursor 23 can be moved to any position of P1–P3 on the LCD 9 in FIG. 5 through the process of S11 in FIG. 4. Further, when the DOWN switch 13 or UP switch 14 is operated, with the cursor 23 being at P1, the poly synchronous ENABLE and DISABLE modes can be changed from one to the other through the DIS./ENA. change process in S16 in FIG. 4. If the cursor 23 is at P2, the lower limit of the poly No. range can be changed through the LOWER change process in S15. If the cursor 23 is at P3, the upper limit of this range can be changed through the UPPER change process in S14.

The MIDI IN process in S3 (FIG. 2A) will now be described. In the following description, after the configuration of the note No. assign control memory (see FIGS. 10A–10H) is described, the detailed operation of the MIDI IN process illustrated in FIGS. 12–14 will be described using examples of the poly synchronous operation according to the MIDI IN process based on FIG. 11.

Figure 10A:
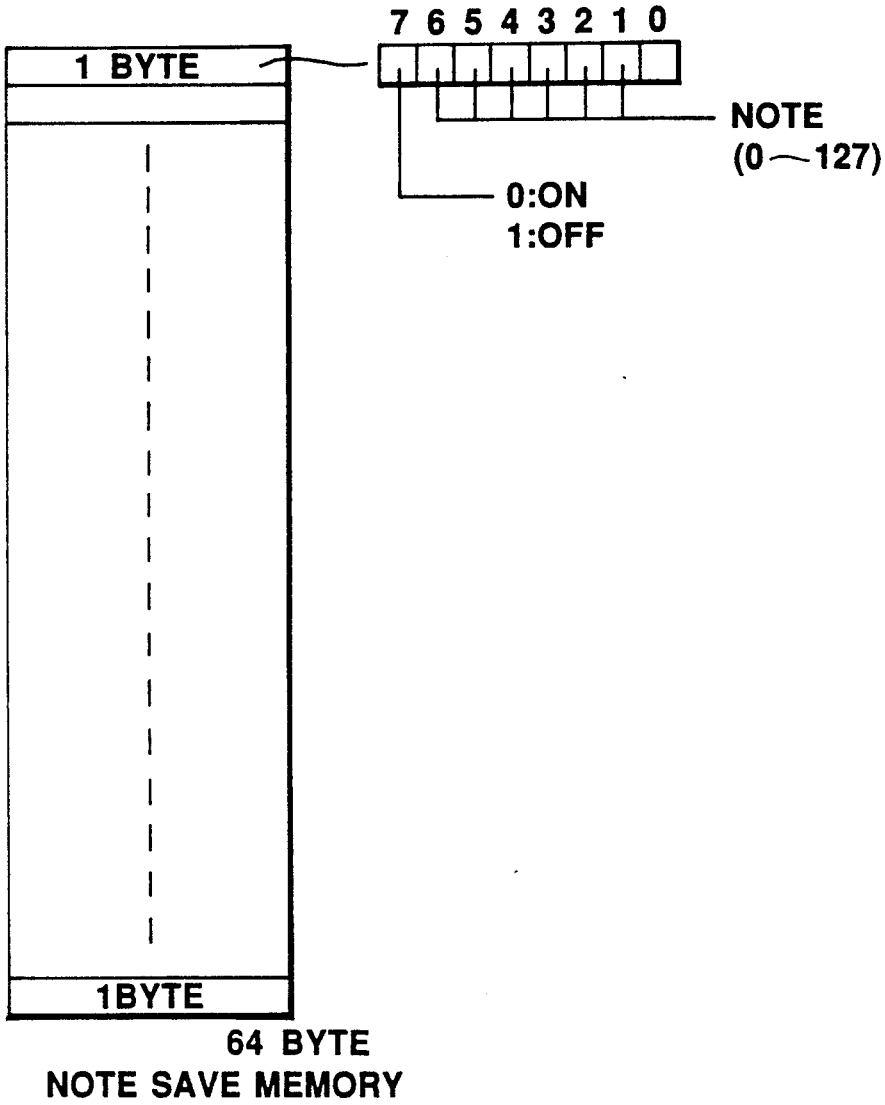

FIGS. 10A–10H illustrate the configuration of the note No. assign control memory constituted in the RAM 3 (see FIG. 1). The NOTE SAVE memory in FIG. 10A has a 64-byte configuration so that data of up to 64 note Nos. can be saved there; each byte corresponds to one of poly Nos. 1–64. As illustrated in FIG. 10A, the lower 7 (0 to 6) bits of each byte represent a note No. which may take any of values 0–127, and the most significant bit (MSB) of No. 7 is an ON/OFF flag. When this flag is "1," the poly No. corresponding to that byte is currently subjected to note off, and in this case, the lower 7 bits will take a value "0." Therefore, the value for one byte at the time of note off is $80_H$ (H indicating a hexadecimal notation). These will be described later.

A brief description of the pointers, counter and flag will now be given. Their detailed description will be given later.

An OFF pointer in FIG. 10B holds the relative address from the head address of the NOTE SAVE memory in which the note No. subjected to note off is saved, which is and the minimum value. This pointer can take any of values 0 to 63 by a combination of the lower 5 bits; a value "0" is set in the upper two bits.

An EMPTY counter in FIG. 10C holds the total number of addresses at which no note No. has been written yet after a note No. is saved once in the NOTE SAVE memory and a value $80_H$ is further written after execution of note off. This pointer can take any of values 0 to 64 by a combination of the lower 6 bits; a value "0" is set in the MSB.

An ON pointer in FIG. 10D holds a value attained by adding "1" to the greatest one of the relative addresses of the note Nos. saved in the NOTE SAVE memory. This pointer can take any of values 0 to 63 by a combination of the lower 5 bits; a value "0" is set in the upper two bits.

As described earlier, the JOB RANGE LOWER pointer in FIG. 10E stores the lower limit of a poly No. which is lower by 1 than the poly No. displayed at P2 on the LCD 9 shown in FIG. 5. This pointer can take any of values 0 to 63 by a combination of the lower 5 bits; a value "0" is set in the upper two bits.

As described earlier, the JOB RANGE UPPER pointer in FIG. 10F stores the upper limit of a poly No. which is lower by 1 than the poly No. displayed at P3 on the LCD 9 shown in FIG. 5. This pointer has the same bit configuration as the JOB RANGE LOWER pointer.

A NOTE ON counter in FIG. 10G holds the total number of note Nos. saved in the NOTE SAVE memory. This pointer can take any of values 0 to 64 by a combination of the lower 6 bits; a value "0" is set in the MSB.

A fag shown in FIG. 10H is provided with a JOB REQUEST flag at the least significant bit (LSB) and a JOB DISABLE flag at the second bit from the LSB. The JOB REQUEST flag holds data indicating whether or not a request should be made as to generate a musical tone with the note No. indicated by entered NOTE ON data. The JOB DISABLE flag is for setting either the DISABLE mode or ENABLE mode for a poly synchronous operation with respect to its sound source module.

A detailed operation of the MIDI IN process according to the first embodiment using the aforementioned note No. assign control memory will now be described along the operation flowcharts shown in FIGS. 12 to 14.

Figure 12:
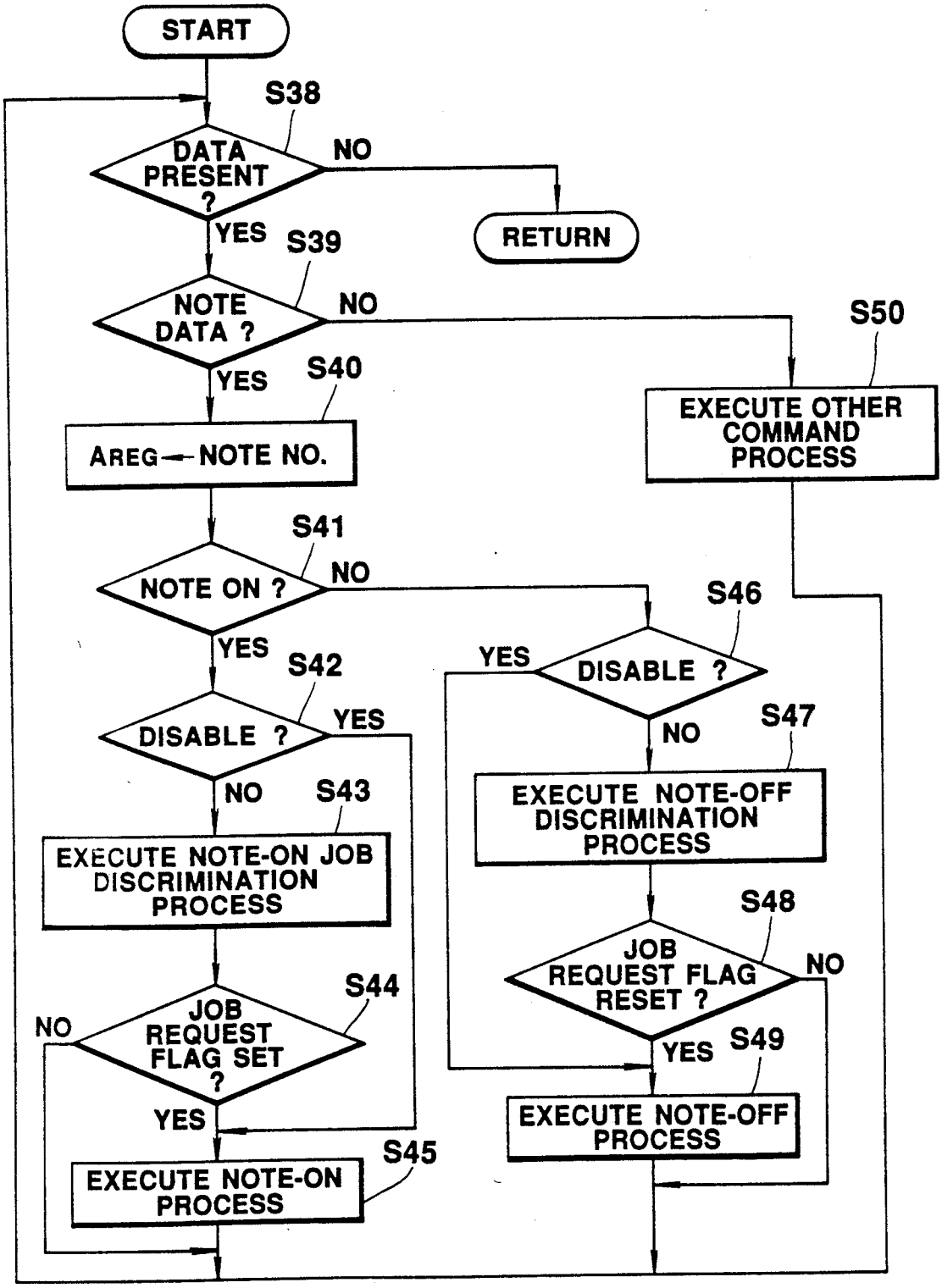
FIG. 12 is an operation flowchart for a MIDI IN process.

FIG. 12 is a detailed operation flowchart for the MIDI IN process in S3 in FIG. 2A.

First, in S38 the CPU 4 in FIG. 1 checks if MIDI data is input via the external input interface circuit 1. If the data has not been input, the decision in S38 is NO so that the MIDI IN process in S3 in FIG. 2A is immediately terminated and S3 is repeated again through the switch change process of S2. Accordingly, a status of being ready for input of MIDI data is maintained by repetitively executing S38.

When MIDI data is input and the decision in S38 becomes YES, the flow advances to S39 where it is discriminated whether the MIDI data is NOTE ON data or NOTE OFF data. If the decision is NO, the flow advances to S50 where a process other than note on and note off is executed, then S38 is repeated.

When NOTE ON data or NOTE OFF data is input and the decision in S39 becomes YES, the flow advances to S40 where a note No. included in that data is loaded into the register $A_{REG}$ in the CPU 4.

In the subsequent step S41, it is discriminated whether the input MIDI data is NOTE ON data or NOTE OFF data. When NOTE ON data is input and the decision in S41 becomes YES, the flow advances to S42 where it is discriminated whether the mode is the poly synchronous ENABLE mode or DISABLE mode.

In case of the DISABLE mode (when the display at P1 in FIG. 5 is "OFF"), the decision in S42 becomes YES and the flow advances to S45 where a NOTE ON process is executed in accordance with the note No. set in the register $A_{REG}$. Then, the flow returns to S38. That is, the operation in this case is an ordinary tone generating operation of the sound source module, so that the CPU 4 (FIG. 1) gives an instruction to the sound source circuit 6 to generate a musical tone without any condition at the pitch corresponding to the note No. of the NOTE ON data.

In case of the ENABLE mode (when the display at P1 in FIG. 5 is "ON"), the decision in S42 becomes NO and the flow advances to S43 where the NOTE ON JOB discrimination process is executed. This process is one of the most important characteristics of this embodiment. In this process it is determined whether or not the NOTE ON process should be executed, and if the process should be executed, the JOB REQUEST flag in the note No. assign control memory in FIG. 10H is set to 1 and if not, the flag is reset to 0. A detailed description of the NOTE ON JOB discrimination process will be given later.

If the JOB REQUEST flag is set to 1 through the above process, the decision in S44 becomes YES and the flow advances to S45 where the NOTE ON process is executed. If the flag is reset to 0, the decision in S44 becomes NO and the flow returns to S38 without executing the NOTE ON process.

When NOTE OFF data is input and the decision in S41 becomes NO, on the other hand, the flow advances to S46 where the same discrimination as done in S42 is made.

In case of the DISABLE mode, the decision in S46 becomes YES and the flow advances to S49 where a NOTE OFF process is executed in accordance with the note No. set in the register $A_{REG}$. Then, the flow returns to S38. That is, the operation in this case is an ordinary note off operation of the sound source module, so that the CPU 4 (FIG. 1) gives an instruction to the sound source circuit 6 to stop generating a presently-generated musical tone corresponding to the note No. of the NOTE OFF data, without any condition.

In case of the ENABLE mode, the decision in S46 becomes NO and the flow advances to S47 where the NOTE OFF JOB discrimination process is executed. This process, like the NOTE ON JOB discrimination process, is also the most important characteristic of the first embodiment. In this process it is determined whether or not the NOTE OFF process should be executed, and if the process should be executed, the JOB REQUEST flag is set in S48 to 1 and if not, the flag is reset to 0. A detailed description of the NOTE OFF JOB discrimination process will be given later.

If the JOB REQUEST flag is set to 1 through the above process, the decision in S48 becomes YES and the flow advances to S49 where the NOTE OFF process is executed. If the flag is reset to 0, the decision in S48 becomes NO and the flow returns to S38 without executing the NOTE OFF process.

The operation flowcharts of FIGS. 13A and 13B associated with the NOTE ON JOB discrimination process in S43 in FIG. 12 and those of FIGS. 14A and 14B associated with the NOTE OFF JOB discrimination process in S47 will now be explained according to the operational examples illustrated in FIG. 11.

The foregoing description of the first embodiment has been given with reference to a single sound source module. Assume that in that sound source module poly Nos. 9 to 16 are specified through the switch change process in S2 in FIG. 2A, as shown in FIG. 5. With the note No. assign control memory being initialized in S1 in FIG. 2A, S20 in FIG. 6 or S36 in FIG. 9, as shown in FIG. 11(*a*), ON pointer=0
JOB RANGE LOWER pointer=8
JOB RANGE UPPER pointer=15
EMPTY counter=0
NOTE ON counter=0
OFF pointer=unsettled.

In this initialized state, the content of the NOTE SAVE memory is not settled.

When a keyboard or the like coupled externally to the sound source module is played and NOTE ON data with note Nos. $20_H$ to $34_H$ for 21 notes are sequentially input to the CPU 4 through the external input interface circuit 1 (FIG. 1), the value of the ON pointer is changed to 21 from 0, so is the value of the NOTE ON counter, as shown in FIG. 11(*b*). Accordingly, the individual data of note Nos. $20_H$–$34_H$ is saved at the sequential relative address 0 to 20 starting from the head address in the NOTE SAVE memory. The value of the OFF pointer is unsettled. In this case, in the state shown in FIG. 11(*b*), the CPU 4 issues a tone generation instruction to the sound source circuit 6 only with respect to the note Nos. data saved at the relative addresses 8–15 associated with the poly Nos. data designated by the JOB RANGE LOWER pointer and JOB RANGE UPPER pointer. Accordingly, this sound source module generates 8 polyphonic tones corresponding to the poly Nos. 9–16.

The operation in the state shown in FIG. 11(*b*) is realized as follows.

First, the MIDI IN process of S3 in FIG. 2A is repeated once every time one piece of NOTE ON data is input. Each time the process is repeated, the sequence of processes, S38→S39→S40→S41→S42→S43, is executed to enter the NOTE ON JOB discrimination process as illustrated in FIGS. 13A, 13B.

Figure 13A:
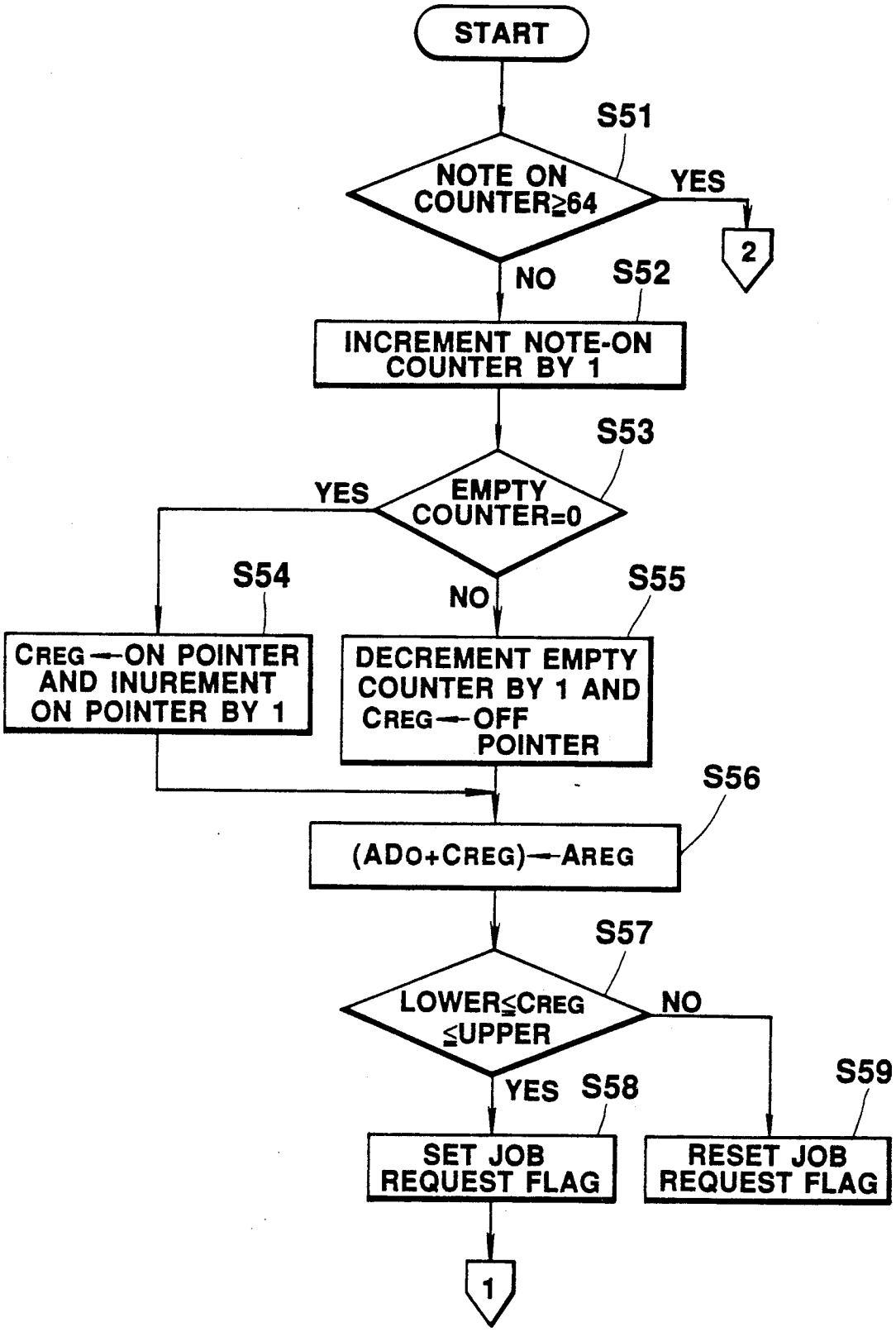
FIGS. 13A and 13B illustrate an operation flowchart for a NOTE ON JOB discrimination process.

In S51 in FIG. 13A, it is discriminated whether or not the value of the NOTE ON counter is equal to or greater than 64. If the value is equal to or greater than 64, the flow advances to S66 of FIG. 13B where the JOB REQUEST flag is reset and the NOTE ON JOB discrimination process of S43 in FIG. 12 will be terminated. In other words, the process of S51 is a discrimination process for not permitting generation of beyond the 65th tone since the maximum number of polyphonic tones or the maximum number of simultaneous generatable tones is 64 in the first embodiment. When the JOB REQUEST flag is reset to 0, the decision in S44 becomes NO and the NOTE ON process will not be further executed. In the example of FIG. 11(*b*), in the initialized state, the value of the NOTE ON counter is equal to or less than 63, so that the decision in S51 becomes YES and the flow advances to S52.

In S52 the value of the NOTE ON counter is incremented by 1. In the example of FIG. 11(*b*), the value of the NOTE ON counter is changed from 0 to 21 by repeating the process of S52 every time each note No. is input.

Figure 11:
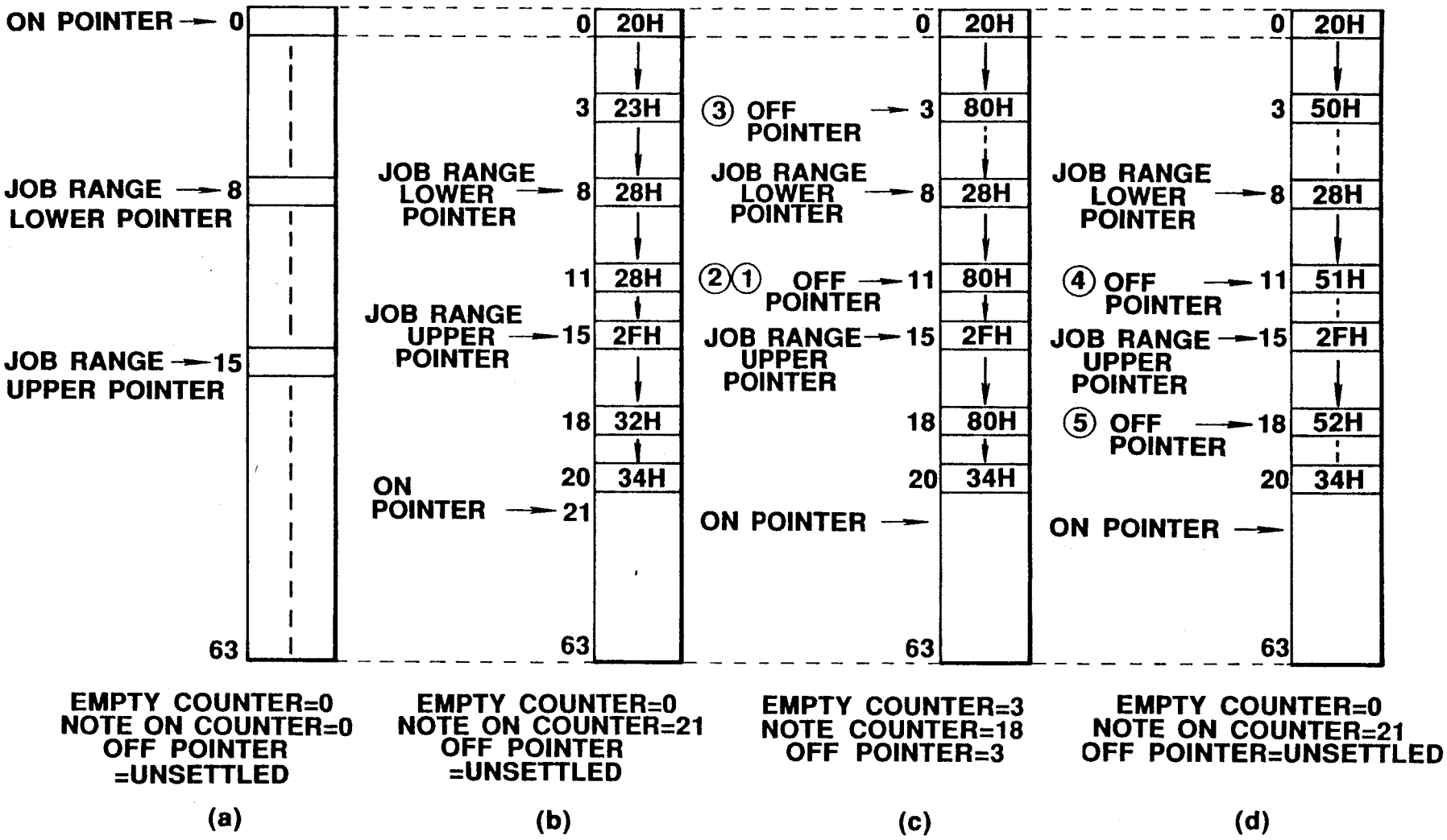
FIGS. 11 is a diagram showing examples of a poly synchronous operation.

In S53 it is discriminated whether or not the value of the EMPTY counter is "0." As it is "0" in the example of FIG. 11(*b*), the flow advances to S54.

In this step, after the value of the ON pointer is loaded into the register $C_{REG}$, the value of the ON pointer is incremented by 1. That is, since the ON pointer holds a value attained by adding "1" to the greatest one of the relative addresses of the note Nos. data saved in the NOTE SAVE memory, as described earlier with reference to FIG. 10D, the relative address at which the present note No. data should be saved is set in the register $C_{REG}$ by repeating the process of S54 every time each note No. data is input. In the example of FIG. 11(*b*), the value of ON pointer is changed from 0 to 21.

In S56, the head address (absolute address) $AD_0$ of the NOTE SAVE memory as shown in FIG. 10A is added with the relative address set in the register $C_{REG}$ to compute the absolute address corresponding to this relative address, and the note No. data set in the register $A_{REG}$ in S40 in FIG. 12 is saved at that address. By repeating this process of S54 every time each note No. data is input, the individual note Nos. $20_H$–$34_H$ data is saved at the sequential relative addresses 0–20 starting from the head address in the NOTE SAVE memory in the case of FIG. 11(*b*).

In S57, it is discriminated whether or not the relative address set in the register $C_{REG}$ falls within the range determined by the values of the JOB RANGE LOWER pointer and JOB RANGE UPPER pointer. If the address falls in this range, the JOB REQUEST flag is set to 1 in S58 and if not, the flag is reset to 0 in S59. By repeating the decision in S57 when each note No. data is input, the JOB REQUEST flag is set to 1 only for the note Nos. data saved at the relative addresses 8–15 and the flag is reset to 0 otherwise in the case of FIG. 11(*b*).

Figure 13B:
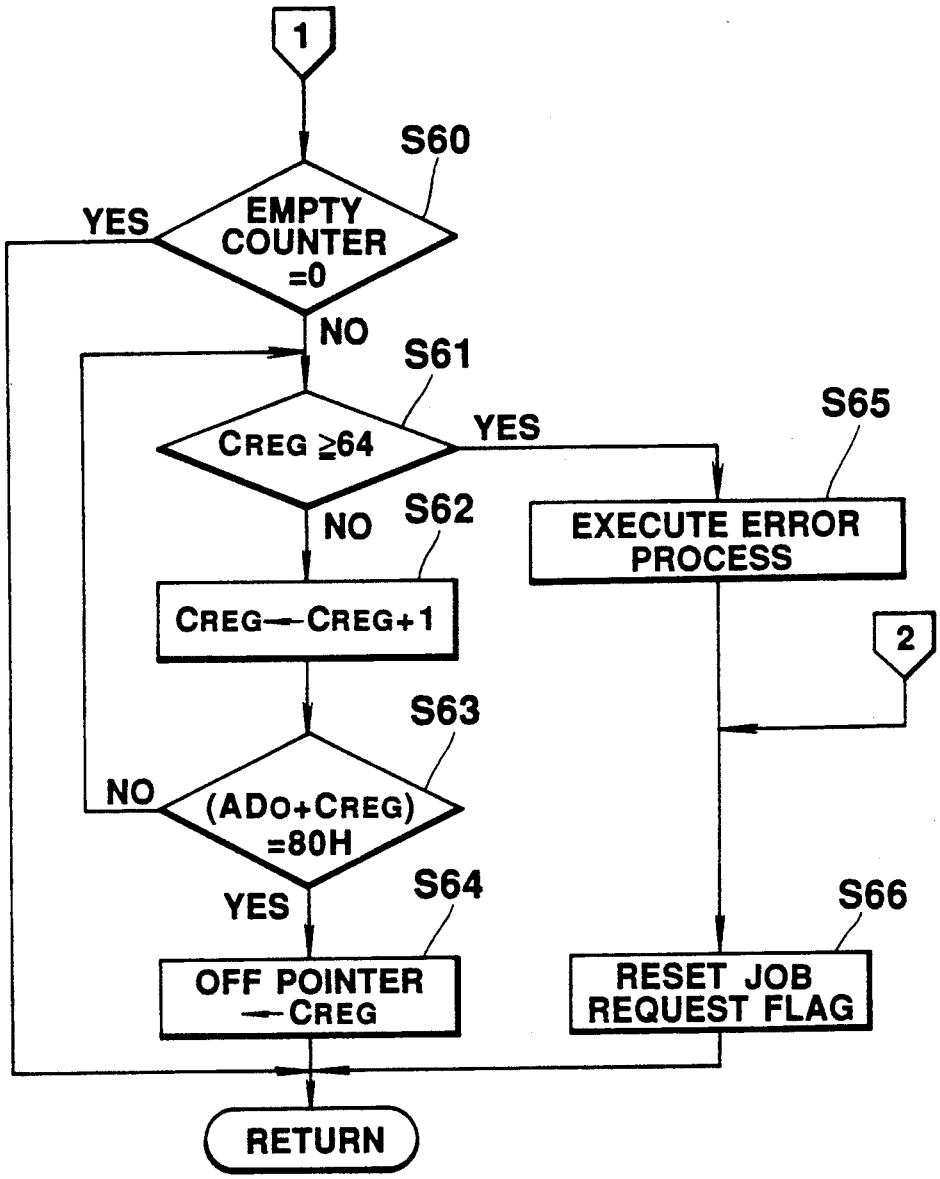

In the subsequent step S60 in FIG. 13B, it is discriminated whether or not the value of the EMPTY counter is "0." As it is "0" in the case of FIG. 11(*b*), the decision therein is YES and the NOTE ON JOB discrimination process of S43 in FIG. 12 will be terminated.

The decision in S44 in FIG. 12 becomes YES only when the JOB REQUEST flag is set to 1, and the flow advances to S45 where the NOTE ON process is executed. By repeating the discrimination process of S44 every time each note No. data is input, as described above, a tone generation instruction is issued to the sound source circuit 6 (FIG. 1) only for the note Nos. data saved at the relative addresses 8–15 in the case of FIG. 11(*b*).

Returning to FIG. 11, when keys on an external keyboard or the like corresponding to the individual note Nos. $2B_H$, $32_H$ and $23_H$ are released in the state of (b) in the same diagram and the NOTE OFF data associated with these note Nos. are input in the named order, $80_H$ indicating note off in progress is stored at the relative addresses 11, 18 and 3 where the note Nos. $2b_H$, $32_H$ and $23_H$ data has been stored. At the same time, the value (relative address) of the OFF pointer is changed in the sequence of unsettled→11→11→3 ((1)→(2)→(3) in FIG. 11(*c*)). In the process of (2), since the relative address 18 where the note No.=$32_H$ has been stored is greater than the relative address 11 where the note No.=$2B_H$ has been stored, the value of the OFF pointer is not changed to 18. The values of the EMPTY counter changes in the sequence of 0→1→2→3 and the value of the NOTE ON counter changes in the sequence of 21→20→19→18. The value of the ON pointer does not change. In this case, only for the relative address 11 among the relative addresses 8–15 indicated by the JOB RANGE LOWER pointer and JOB RANGE UPPER pointer where the note No.=$2B_H$ has been stored and is replaced by a value $80_H$, the CPU 4 (FIG. 1) issues a note off instruction to the sound source circuit 6 shown in FIG. 1 to stop generating a musical tone having that note No. in the state of FIG. 11(*c*).

The operation in the state shown in FIG. 11(*c*) is realized as follows.

First, the MIDI IN process of S3 in FIG. 2A is repeated once every time one piece of NOTE OFF data is input. Each time the process is repeated, the sequence of processes, S38→S39→S40→S41→S46→S47, is executed to enter the NOTE OFF JOB discrimination process as illustrated in FIGS. 14A and 14B.

Figures 14A, 14B:
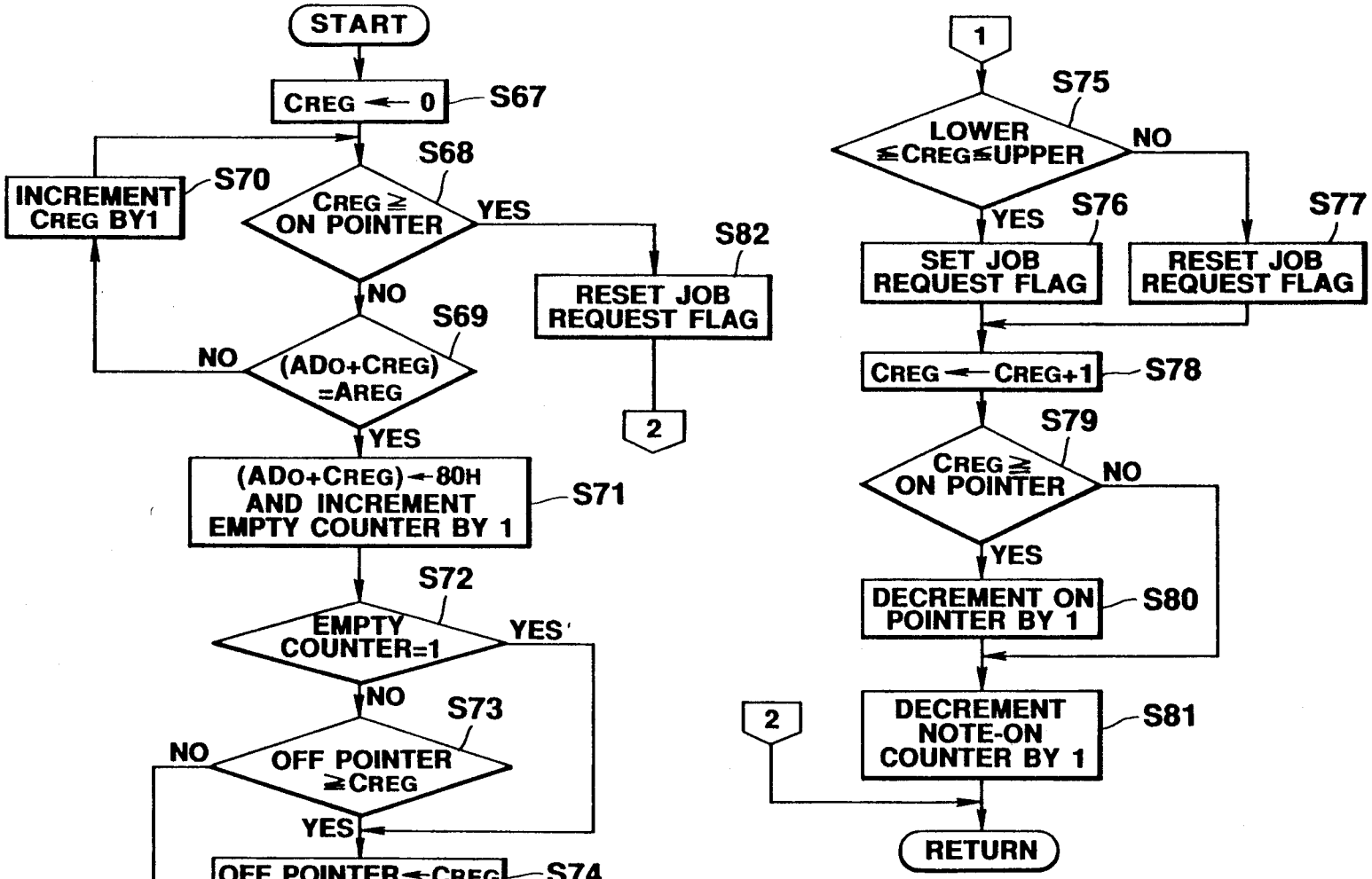
FIGS. 14A and 14B illustrate an operation flowchart for a NOTE OFF JOB discrimination process.

In S67 in FIG. 14A, "0" is set in the register $C_{REG}$, and while incrementing the value of the register $C_{REG}$ by 1 in S70 in the loop of S68→S69→S70→S68, the note Nos. to be subjected to note off is compared with the content of the NOTE SAVE memory at the address ($AD_0+C_{REG}$) to find the one which coincides with the memory content. In S68 it is discriminated whether or not the relative address indicated by the $C_{REG}$ has reached the value of the ON pointer beyond which no note Nos. data exist in the NOTE SAVE memory. If the relative address reaches this value, the decision in S6 becomes YES, the JOB REQUEST flag is reset to 0 in S82 and the NOTE OFF JOB discrimination process of S47 in FIG. 12 will be terminated. In this case, therefore, corresponding note Nos. data does not exist any more in the NOTE SAVE memory and the decision in S48 in FIG. 12 becomes NO so that the NOTE OFF process in S49 will not be executed. By repeating the loop of S68→S69→S70→S68 in FIG. 14A, the relative addresses 11, 18 and 3 where the note Nos. $2B_H$, $32_H$ and $23_H$ data that should be subjected to note off have been stored, are retrieved.

Every time the relative address whose content coincides with a note No. to be subjected to note off is retrieved, the decision in S69 becomes YES and the flow advances to S71. In this step the value $80_H$ data indicating note off in progress is stored at the retrieved address ($AD_0+C_{REG}$) and the value of the EMPTY counter is incremented by 1. By repeating the process of S71 every time each note No. data is input, the value $80_H$ data indicating the note off in progress is stored at the relative addresses 11, 18 and 3 and the value of the EMPTY counter is changed in the sequence of 0→1→2→3 at the same time in the example of FIG. 11(*c*).

In the subsequent step S72 it is discriminated whether or not the value of the EMPTY counter is 1. If the value is 1, the value data of the register $C_{REG}$ is saved in the OFF pointer in S74. This process is executed when the relative address 11 associated with the first note No.$=2B_H$ is retrieved and the value data of the OFF pointer is changed from an "unsettled" state to 11 in the example of FIG. 11(*c*).

If the decision in S72 is NO, the value of the OFF pointer is compared with the value of the register $C_{REG}$ in S73. If the value of the register $C_{REG}$ is greater, the value of the OFF pointer is not changed. This process is executed when the relative address 18 associated with the second note No.$=32_H$ is retrieved and the value data of the OFF pointer is left unchanged at 11 in the example of FIG. 11(*c*).

If the value of the register $C_{REG}$ is smaller than the value of the OFF pointer, on the other hand, the value data of the register $C_{REG}$ is saved in the OFF pointer. This process is executed when the relative address 3 associated with the third note No.$=23_H$ is retrieved and the value of the OFF pointer is changed from 11 to 3 in the example of FIG. 11(*c*).

Through the processes of S72–S74, the OFF pointer holds the smallest one of the relative addresses where the value $80_H$ data indicating the note off in progress is stored.

In S75 of FIG. 14B, it is discriminated whether or not the relative address set in the register $C_{REG}$ falls within the range determined by the values of the JOB RANGE LOWER pointer and JOB RANGE UPPER pointer. If the address falls in this range, the JOB REQUEST flag is set to 1 in S76 and if not, the flag is reset to 0 in S77. By repeating the decision in S75 when each note No. is input, the JOB REQUEST flag is set to 1 only for the relative address 11 among the relative address 8–15 where the note No.$=2B_H$ data has been stored but is replaced by the value $80_H$, and the flag is reset to 0 otherwise in the case of FIG. 11(*c*).

In the subsequent step S78, the value of the register $C_{REG}$ is incremented by 1. The values of this register is compared with the value of the ON pointer in S79. If the former value is equal to or greater than the latter one, the value of the ON pointer is decremented by 1 in S80. Through these processes, when the note No. whose associated relative address is the greatest is subjected to note off, the value of the ON pointer is set to the relative address whose note No. has been subjected to note off. The decision in S79 is always NO in the example of FIG. 11(*c*), and the value of the ON pointer does not change.

Finally, in S81, the value of the NOTE ON counter is decremented by 1 and the NOTE OFF JOB discrimination process of S47 in FIG. 12 will be terminated. By repeating the process of S81 every time each note No. is input, the value of the NOTE ON counter changes in the sequence of 21→20→19→18 in the example of FIG. 11(*c*).

If and only if, after execution of the above processes, "1" is set in the JOB REQUEST flag in S76 in FIG. 14B, the decision in S48 in FIG. 12 becomes YES and the flow advances to S49 where the NOTE OFF process is executed. By repeating the discrimination process of S48 every time each note No. is input, a note off instruction is given to the sound source circuit 6 shown in FIG. 1 only for the relative address 11 among the relative addresses 8–15 where the note No.$=2B_H$ data has been stored but is replaced with the value $80_H$ in the example of FIG. 11(*c*).

Returning again to FIG. 11, assume that in the state of (c) in this diagram, a new key depression on the external keyboard or the like is performed and NOTE ON data corresponding to note Nos. $50_H$, $51_H$ and $52_H$ are sequentially input.

First, when the NOTE ON data of the note No.$=50_H$ is input, $50_H$ is written at the relative address 3 indicated by the OFF pointer and the value of the OFF pointer is changed to smallest relative address 11 at which the value $80_H$ data indicating the note off in progress is stored. The value of the EMPTY counter is decremented by 1 to be changed to 2 from 3, and the value of the NOTE ON counter is incremented by 1 to be changed to 19 from 18. When the NOTE ON data of the note No.$=51_H$ is input, $51_H$ is written at the relative address 11 indicated by the OFF pointer and the value of the OFF pointer is changed to relative address 18. The value of the EMPTY counter is changed to 1 from 2, and the value of the NOTE ON counter is changed to 20 from 19. Further, when the NOTE ON data of the note No.$=52_H$ is input, $52_H$ data is written at the relative address 18 indicated by the OFF pointer and the value of the OFF pointer becomes unsettled. The value of the EMPTY counter is changed to 0 from 1, and the value of the NOTE ON counter is changed to 20 from 21. In other words, through the above operation, the value of the OFF pointer changes from the state (3) in FIG. 11(*c*) to (4) and (5) in FIG. 11(*d*). In this case, the CPU 4 issues a tone generation instruction to the sound source circuit 6 only for the note No. $51_H$ data saved at the relative address 11 included in the relative addresses 8–15 associated with the poly Nos. indicated by the JOB RANGE LOWER pointer and JOB RANGE UPPER pointer in the state of FIG. 11(*d*).

The operation in the state transition from (c) to (d) in FIG. 11 is realized as follows.

First, the MIDI IN process of S3 in FIG. 2A is repeated once every time one piece of NOTE ON data is input. Each time the process is repeated, the sequence of processes, S38→S39→S40→S41→S42→S43, is executed to enter the NOTE ON JOB discrimination process as illustrated in FIGS. 13A and 13B, as in the case of FIG. 11(*b*).

When the NOTE ON data of the note No.$=50_H$ is input in the state of FIG. 11(*c*), the decision in S51 becomes NO and the value of the NOTE ON counter is changed to 19 from 18 in S52.

Then, the decision in S53 is NO since the present value of the EMPTY counter is 3 (state of FIG. 11(*c*)), and the flow advances to S55. In S55 the value of the EMPTY counter is decremented by 1 to be changed to 2 from 3, and the value of the OFF pointer is loaded into the register $C_{REG}$.

In the subsequent step S56, the note No. data stored in the register $A_{REG}$ is saved at an address attained by adding the relative address of the register $C_{REG}$ to the head address $AD_0$. In the example of transition from FIG. 11(*c*) to FIG. 11(*d*), when the note No.=$50_H$ data is input, $50_H$ data is written at the relative address 3.

The processes associated with the JOB REQUEST flag in S57–S59 are exactly the same as those in the case of FIG. 11(*b*); with the note No.=$50_H$, the value '3" of the register $C_{REG}$ does not satisfy the conditions of S57, and the JOB REQUEST flag is reset to 0 in S59.

Then, the decision in S60 is NO since the present value of the EMPTY counter is 2, and the flow advances to S61.

The loop of S61→S62→S63→S61 is a process for moving the OFF pointer to the youngest relative address at which $80_H$ data indicating the tone off in progress is stored since a new note No. data is saved at the relative address which has been indicated by the OFF pointer. In other words, while incrementing the value of the register $C_{REG}$ by 1 in S62, the content of the address ($AD_0+C_{REG}$) is compared with $80_H$ indicating the tone off in progress to check if they coincide with each other in S63. In S61 it is discriminated whether or not the range of the above retrieval exceeds the upper limit 63 of the relative address in the NOTE SAVE memory. If the value of the EMPTY counter is not 0, there should be one other relative address which indicates the tone off in progress, so that the decision in S61 cannot become YES. If it becomes YES for some reasons, however, the flow advances to S65 where the proper error process is executed. Then, the JOB REQUEST flag is reset to 0 in S66. That is, in this case, the decision in S44 in FIG. 12 (which will be described later) becomes NO and no note off operation is executed.

If the decision is YES in S63 and the relative address indicating the note off in progress is found, the value data of the register $C_{REG}$ indicating it is saved in the OFF pointer in S64. As a result, when the note No.=$50_H$ is input in the example of (c)→(d) in FIG. 11, the value of the OFF pointer is changed to 11 from 3.

Through the above processes, the NOTE ON JOB discrimination process of S43 in FIG. 12 is completed.

After execution of the above operation, the value of the JOB REQUEST flag is discriminated in S44. When the note No.=$50_H$ is input in the example of (c)→(d) in FIG. 11, since the JOB REQUEST flag is reset to 0 as described earlier, the decision in S44 becomes NO and the NOTE ON process will not be executed.

When the other note Nos. $51_H$ and $52_H$ are input, the same operation will be performed as in the case of (c)→(d) in FIG. 11.

As described above, the sound source module has the NOTE SAVE memory for storing data of the status associated with the poly Nos. assigned to this module as well as the poly Nos. assigned to all the other sound source modules, and the content of this memory is updated every time the NOTE ON data and NOTE OFF data are input. When a plurality of sound source modules are mutually connected, this operation will be executed for each sound source module in synchronism with the other modules. This is because the NOTE ON data and NOTE OFF data are input to all the sound source modules in parallel and each sound source module updates the content of its own NOTE SAVE memory according to the same rule. Further, each sound source module performs a tone generating operation only when the note No. based on an NOTE ON instruction is set within the range of poly Nos. set to this module, and performs a note off operation only when a NOTE OFF instruction is given with respect to the note Nos. set within the range. Accordingly, each sound source module can execute an polyphonic operation separately.

Although the NOTE ON data or NOTE OFF data input as MIDI data is normally affixed with an identification code called a MIDI channel, no particular process is executed for this MIDI channel in this embodiment. The MIDI channel, which, only when the same data is input, permits its channel number to receive this data, can permit individual musical instruments to receive or transmit separate data. There may be a case where even a single sound source module can designate a plurality of MIDI channels and thus has a function to generate plural types of musical tones under separate controls. To allow this embodiment to cope with such a function, the range of poly Nos., for example, need to be designated for each MIDI channel. Alternatively, the operation flowchart shown in FIGS. 10A and 10H corresponding to the MIDI IN process of S3 in FIG. 2A may be independently operated in time-divisional manner for each MIDI channel, and only the note data whose associated MIDI channels coincide with each other needs to be loaded for each operation flowchart.

The sound source module may be equipped with keys.

Although only the note on and note off instructions are controlled based on poly Nos. according to the first embodiment, this embodiment is in no way limited to this system. For instance, the same control may be executed when MIDI data, bend data or the like which changes the pitch for a predetermined note No., thereby permitting a plurality of sound source modules to cooperatively perform a bend control, etc. The same control may be applied to a case where various effects are added.

According to the first embodiment, when a plurality of sound source modules are mutually connected and are operated simultaneously, the contents of the note data memory means of the individual sound source modules are updated fully in accordance with the same rule, and each module executes tone generation control dealing with only the polyphonic channels in the second polyphonic region which are designated for this module. Accordingly, the connected sound source modules as a whole can function as if tone generation is executed by a single sound source module, and it is possible to expand the number of polyphonic channels in accordance with the number of sound source modules connected.

Particularly, the polyphonic region designating means of each sound source module can arbitrarily set the second polyphonic region by specifying its upper and lower limits, and different numbers of polyphonic channels may be set for the individual sound source modules, or some or all of the modules may freely have the same number of polyphonic channels. This ensures fine expansion of the number of polyphonic channels by making the best use of the characteristic of each sound source module.

Second Embodiment

Figure 15:
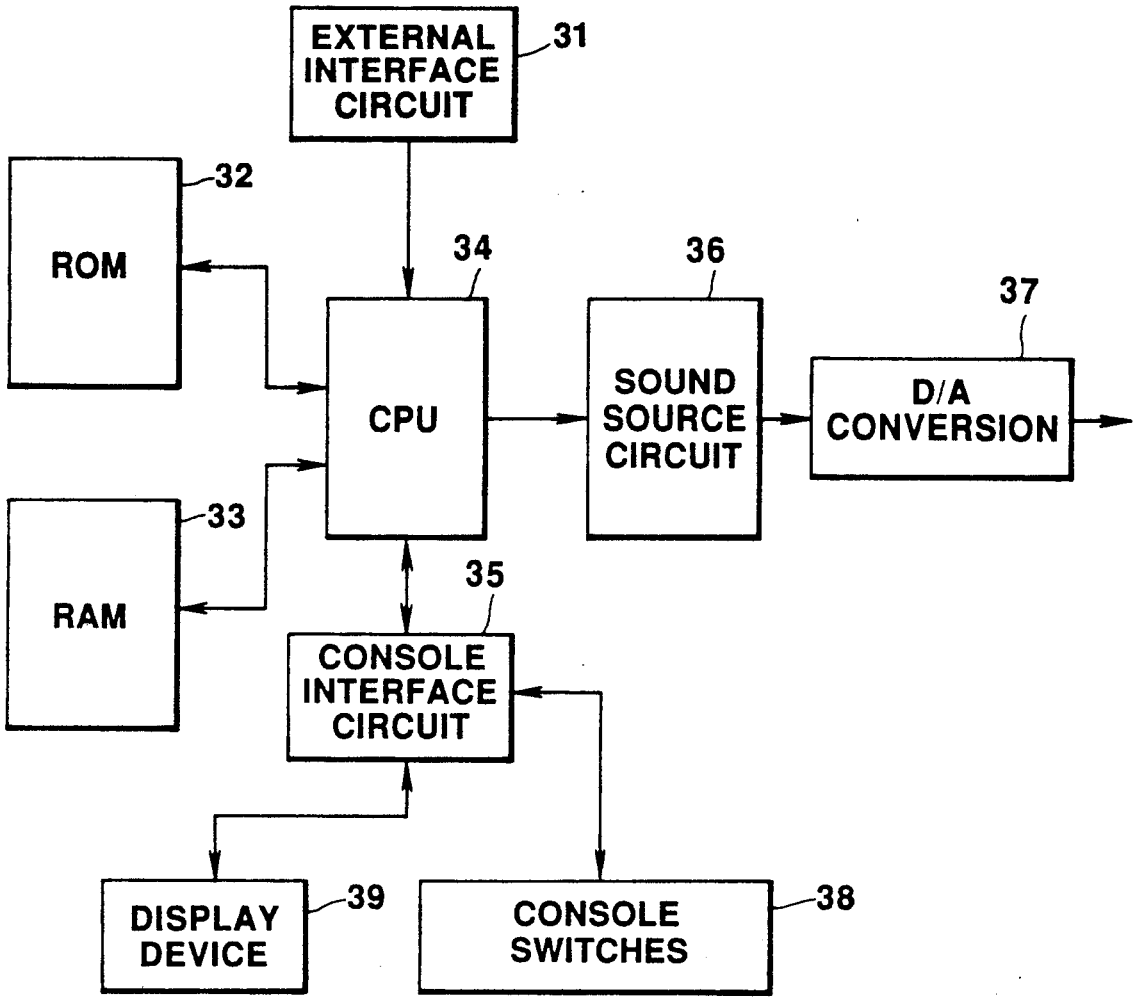
FIG. 15 is a diagram illustrating the general structure of the second embodiment of the present invention.

FIG. 15 is a diagram of the general structure of the second embodiment of the present invention. Since the individual elements or sections in this diagram are the same as those in FIG. 1, their descriptions will be omitted.

BRIEF OPERATION OF SECOND EMBODIMENT

According to the second embodiment, a plurality of electronic musical instruments of a sound source module type structured as illustrated in FIG. 15, which generate a musical tone based on musical tone data externally received, are mutually connected via a MIDI, an exclusive interface for musical tone data transfer, and these modules are used as a single electronic musical instrument. In general, a single sound source module is capable of simultaneously generating about eight polyphonic tones. According to the prior art, even if a plurality of sound source modules of this type are mutually connected, eight polyphonic tones are merely generated in superimposed manner by the number of the modules or if musical tones are concentrated on a certain tone region, some musical tones may not be sounded. According to the second embodiment, if two 8-tone polyphonic type sound source modules are connected, they can be used as a 16-tone single musical instrument. A maximum of 8 sound source modules can be mutually connected, thus realizing a 64-tone polyphonic.

Accordingly, a poly No. is defined within a maximum range of 8 polyphonic tones per sound source module having the structure shown in FIG. 15. In this case, if a machine No. is further defined so that when a player assigns a machine No. 1 to the first sound source module, poly Nos. 1 to 8 are automatically assigned thereto, when the player assigns a machine No. 2 to the second sound source module, poly Nos. 9 to 16 are automatically assigned thereto, and so forth. This can facilitate a setting operation. In this example, if the player starts playing a music using an external keyboard or the like and NOTE ON data (tone generation start data) based on the key-depressing operation is sequentially input via a MIDI to the first and second sound source modules, musical tones with note Nos. (note numbers) indicated by individual pieces of NOTE ON data from the first to eighth tones associated with simultaneously depressed keys are generated from the first sound source module. When individual NOTE ON data of the 9th to 16th tones associated with simultaneously depressed keys are input, musical tones with the associated note Nos. are generated from the second sound source module. When any of the presently-depressed keys is released during this process and associated NOTE OFF data (note off instruction data) is entered, generation of a musical tone with the poly No. assigned with the note No. indicated by that data will be stopped. Thereafter, when new NOTE ON data is input, it is assigned to the youngest one of presently empty or available poly Nos., and a musical tone associated with that data will be generated from the sound source module to which that poly No. is assigned.

All of the mutually connected sound source modules execute the above operation synchronously, so that the player can produce musical tones with the desired number of polyphonic channels by mutually connecting the desired number of sound source modules. For this purpose, the RAM 33 of each sound source module having the structure shown in FIG. 15 has a table called a NOTE SAVE memory for storing a status associated with the poly No. assigned to the sound source module as well as statuses associated with the poly Nos. assigned to all the other sound source modules, and the contents of the individual tables ar updated by the respective sound source modules in complete synchronism with each other in accordance with a given rule, every time each NOTE ON or NOTE OFF data is input. This is an important characteristic of the second embodiment.

In the following description, the operation of one sound source module with the structure shown in FIG. 15 to realize the above-described operation will be explained in detail. According to the second embodiment, it is possible to select for each sound source module between a mode for executing the above polyphonic synchronous operation and a mode for functioning independent of the other sound source modules as in the conventional case. The former mode is called a poly synchronous ENABLE mode, and the latter a poly synchronous DISABLE mode.

DETAILED OPERATION OF SECOND EMBODIMENT

Figure 16A:
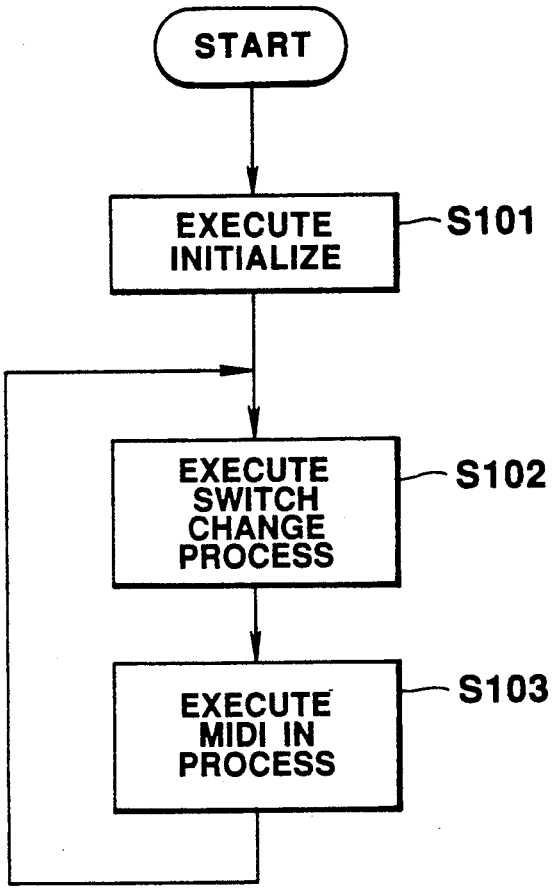
FIG. 16A and 16B illustrate a main operation flowchart.
Figure 16B:
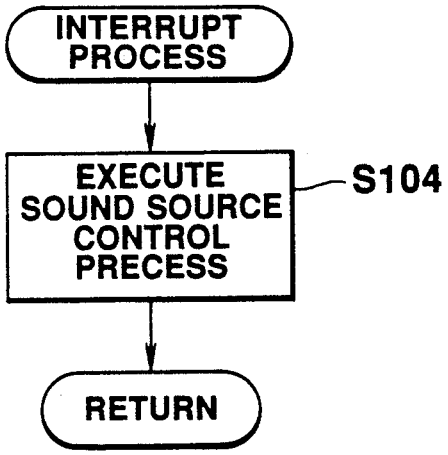

The operation of the second embodiment having the above-described structure will now be explained. FIGS. 16A and 16B illustrate a main operational flowchart of the second embodiment.

To begin with, when a power switch (not shown) is turned ON, an initialization process is executed in S101. This process includes initialization of the contents of the RAM 33 in FIG. 15, resetting of the sound source circuit 36, setting of a timbre, etc.

Tone generation control is executed by repeating a switch change process in S102 and a MIDI IN process in S103 (both will be described later).

In the meantime, an interrupt occurs at given intervals, and a control process for the sound source circuit 36 in FIG. 15 is executed in S104. This process, not directly relevant to the present invention, serves to add a vibrato effect to a musical tone signal to be generated by the sound source circuit 36. Since this effect gives vibration to the pitch of a musical tone at given intervals, it is controlled by the interruption conducted at given intervals as explained above.

Figure 17:
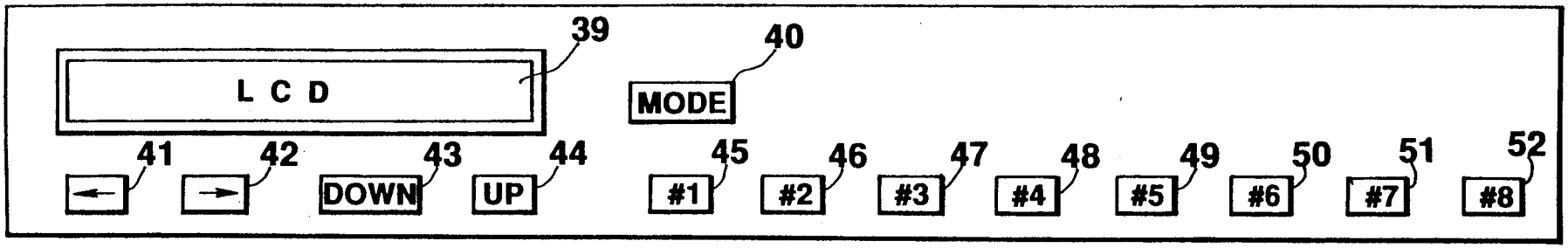
FIG. 17 is an external view of console switches and a display device.

FIG. 17 is an external view of the console switches 38 and display device 39 shown in FIG. 15. Referring to this diagram, "LCD 39" is the display device 39 in FIG. 15. The other switches 40–52 correspond to the console switch 38 in FIG. 15. A mode setting switch (MODE) 40 serves to set a mode for parameters that are displayed by the LCD 39. (This mode setting will be described later.) One of plural pieces of data displayed on the LCD 39 is selected using cursor switches 41 and 42, and the selected data is updated using an UP switch 44 and a DOWN switch 43. Further, the timbre of a musical tone to be generated is selected using switches 45–52 to which #1 to #8 are affixed.

Figure 18:
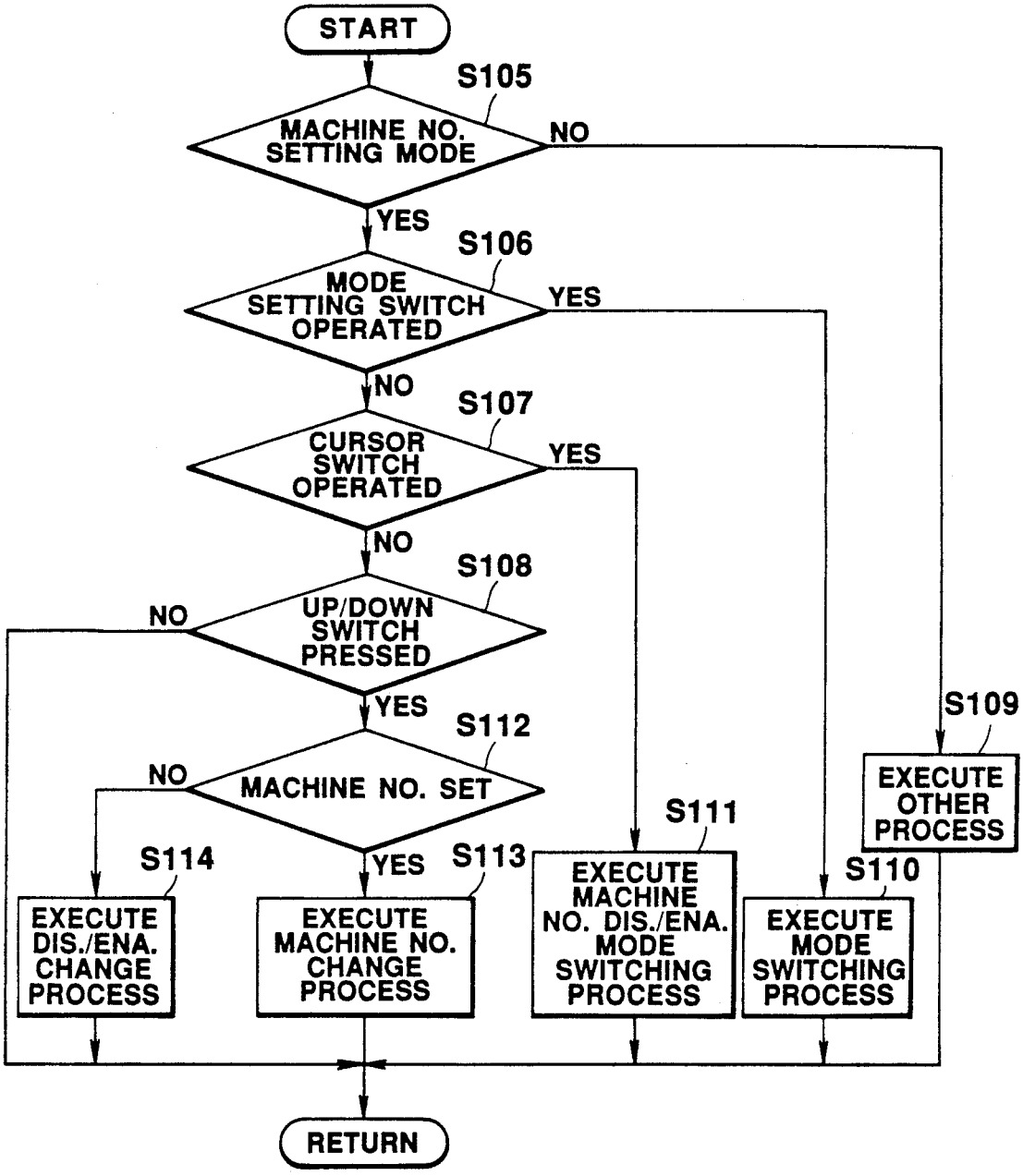
FIG. 18 is an operation flowchart for a switch change process.

FIG. 18 illustrates in detail the switch change process in S102 in FIG. 16A. This process is repeated as shown in FIG. 16A, to always monitor whether or not the individual switches 40 to 52 in FIG. 17 are switched over, and performs a process in mode associated with the changed switch.

In S105 it is discriminated whether or not it is a machine No. setting mode. The LCD 39 can display data of various modes such as data of timbre setting and data of effect setting; the mode display is changed every time the mode setting switch 40 in FIG. 17 is pressed. Of the various modes, the machine No. setting mode is particularly relevant to the present invention. When a mode other than this machine No. setting mode is displayed, the switch change process is terminated after the displayed mode, e.g., setting/changing of the timbre using the switches 45-52 in FIG. 17 or setting/changing of the effect using an associated switch (not shown), is executed in S109.

When the machine No. setting mode is displayed, the flow advances to S106 where it is discriminated whether or not the mode is changed operating the mode setting switch 40 (FIG. 17). If the decision is YES, the flow advances to S110 where the mode on the LCD 39 (FIG. 17) is changed from the present machine No. setting mode to the one selected by the operation of the mode setting switch 40, then the switch change process in S102 in FIG. 16A will be terminated. When the flow enters again to the switch change process in S102 in FIG. 16A after execution of the MIDI IN process in S103, the decision in S105 in FIG. 18 becomes NO and a process for a mode other than the machine No. setting mode is executed in S109, as described above. Though not illustrated, the step S109 has a processing flow similar to the branching from S106 to S110, so that when the mode becomes the machine No. setting mode there by operation of the mode setting switch 40, the decision in S105 becomes YES and the flow returns to the process of the machine No. setting mode.

Figure 19:
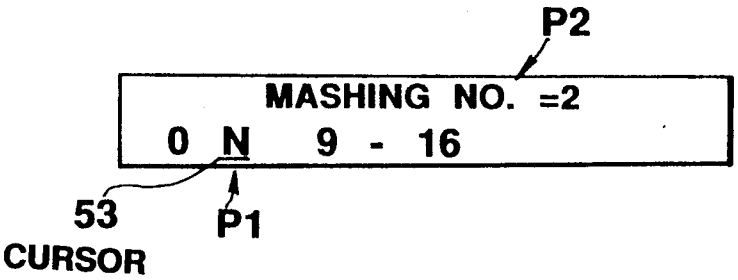
FIG. 19 is a diagram illustrating an example of setting the number of channels or tones to be generated as displayed on the display device.

If the decision is NO in S106, the flow advances to S107 where it is discriminated whether or not either console switch 41 or 42 (FIG. 17) is switched over. If the decision is YES, the flow advances to S111 where one of plural pieces of data displayed on the LCD 39 is selected. According to the second embodiment, the data on the LCD 39 in machine No. setting mode may be as illustrated in FIG. 19. This will be described below more specifically. As already described in "Brief Operation of Second Embodiment," the sound source module according to the second embodiment can set a machine No. for each module and the range of that machine No. is indicated by the numeral shown at position P2 of the LCD 39 in FIG. 19. Two numerals below that position are the poly Nos. which are set by the sound source module associated with the machine No. The illustrated example indicates that poly Nos. 9 to 16 are assigned for the machine No. 2. The symbol "ON" at position P1 in FIG. 19 indicates that the associated sound source module is in poly synchronous ENABLE mode as described in "Brief Operation of Second Embodiment." If this display is "OFF," it indicates the poly synchronous DISABLE mode. The statuses displayed at the individual positions P1 and P2 can be changed by operating the DOWN switch 43 and UP switch 44 (see FIG. 17), and the cursor switches 41 and 42 in FIG. 17 are used to select which one of the statuses at positions P1 and P2 should be changed. More specifically, in FIG. 19 the cursor 53 is presently at position P1 so as to permit alteration of data at P1, but the cursor 23 can be moved between P1 and P2 by pressing the cursor switch 41 or 42, thereby permitting alteration of data at the position where the cursor 53 is moved. This cursor change process is executed in S111 in FIG. 18. After execution of the cursor change process, the switch change process in S102 in FIG. 16A is terminated.

If, after the above processing, the flow returns again to the switch change process in S102 through the MIDI IN process in S103, the decision in S107 (FIG. 17) becomes NO and it is discriminated in S108 whether or not the DOWN switch 43 or UP switch 44 has been depressed. If neither switch has been depressed, the decision in S108 becomes NO and the switch change process in S102 (FIG. 16A) will then be terminated.

When the DOWN or UP switch has been depressed, on the other hand, if the cursor 53 is at P1 on the LCD 39 in FIG. 19, the decision in S112 becomes NO and the DIS./ENA. change process in S114 will be executed. If the cursor 53 is at P2, the decision in S112 is YES so that the MACHINE NO. change process in S113 will be executed.

The above three processes will be described in order.

Figure 20:
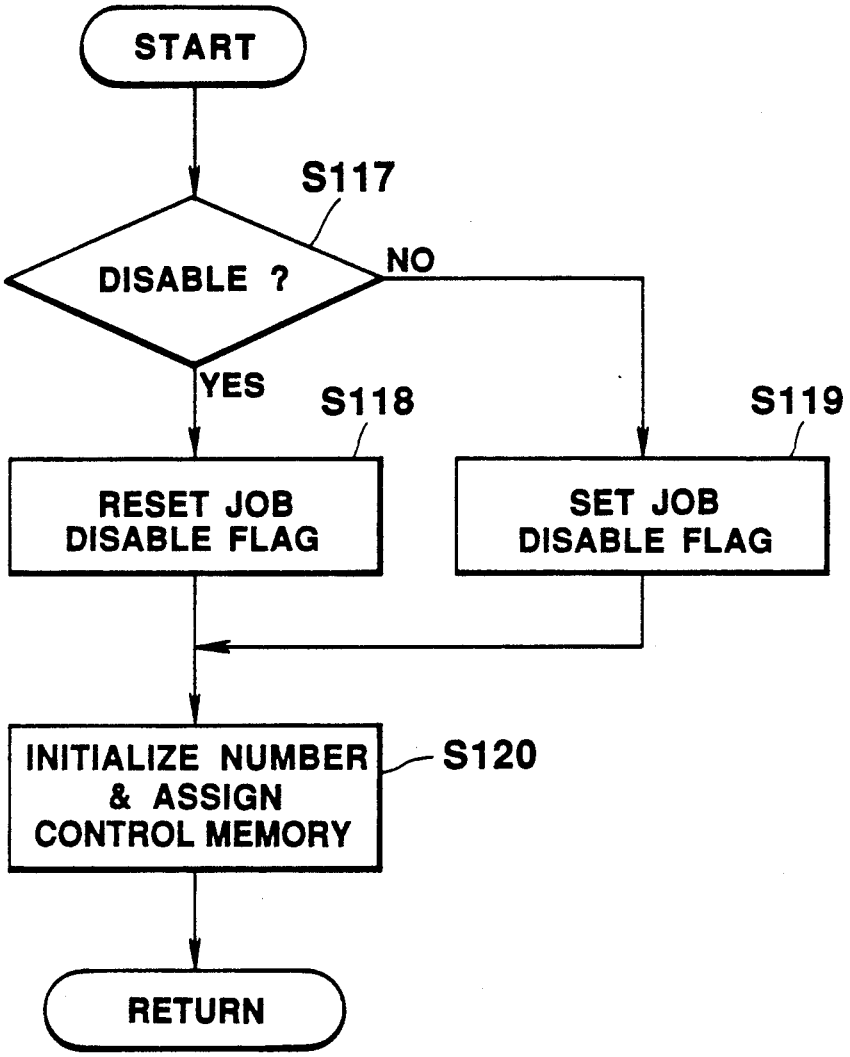
FIG. 20 is an operation flowchart for a DIS./ENA. change process.

First, the DIS./ENA. change process in S114 is to change the present mode of the sound source module to the poly synchronous ENABLE or DISABLE mode through operation of the DOWN switch 43 or UP switch 44, as described earlier. FIG. 20 illustrates in detail the process in S114 in FIG. 18.

In S117 it is discriminated whether the present mode is the poly synchronous DISABLE mode or ENABLE mode.

If it is the DISABLE mode, i.e., if the display at P1 in FIG. 19 is "OFF," the decision in S117 is YES and a JOB DISABLE flag is reset in S118. This flag, whose detailed description will be given later, is for setting either the DISABLE mode or ENABLE mode, and is provided in a note No. assign control memory (see FIGS. 22A-22I) constituted in the RAM 33 in FIG. 15. When reset in S118, this flag is changed for the ENABLE mode. At the same time, the display at P1 in FIG. 19 is changed to "ON."

If the present mode is the ENABLE mode, i.e., if the display at P1 in FIG. 19 is "ON," the decision in S117 becomes NO and the JOB DISABLE flag is set in S119, thus changing the mode to the DISABLE mode. At the same time, the display at P1 in FIG. 19 is change to "OFF."

Each of S118 and S119 is executed by operation of either the DOWN switch 43 or UP switch 44; in this respect, there is no distinction between the DOWN and UP switches.

After execution of step S118 or S119, each pointer, counter, flag and NOTE SAVE memory of the note No. assign control memory (see FIGS. 22A-22I) constituted in the RAM 33 in FIG. 15 are initialized (or cleared to 0) to stop generation of musical tones presently being generated in S120. This memory will be described later.

Upon execution of the operational sequence in FIG. 20 (the DIS./ENA. change process in S114 in FIG. 18), the switch change process in S102 in FIG. 16A will be terminated.

Figure 21:
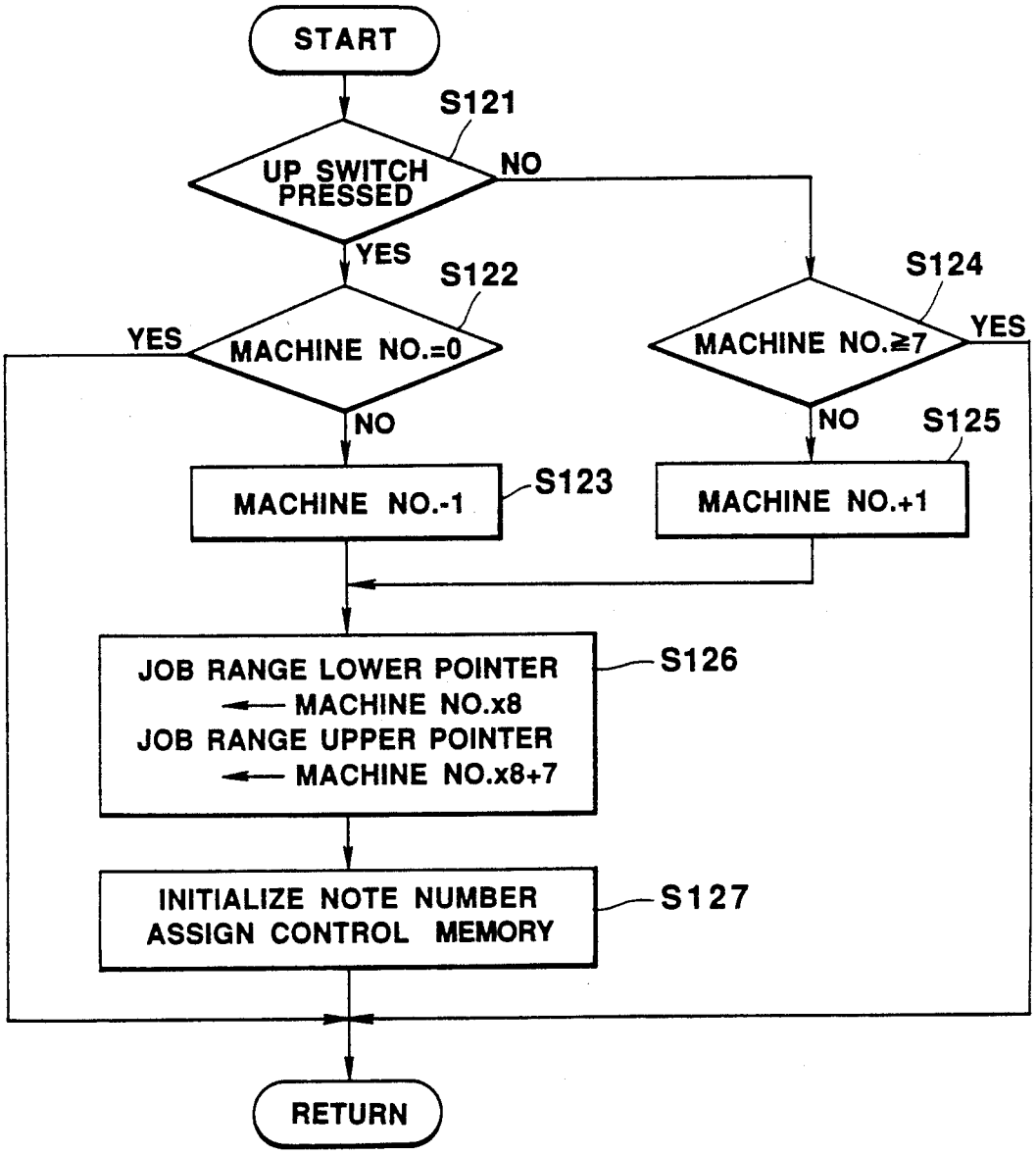
FIG. 21 is an operation flowchart for a MACHINE NO. change process.

The MACHINE NO. change process in S113 in FIG. 18, as described earlier, is for changing the machine No. presently set in the sound source module by operation of the DOWN switch 43 or UP switch 44 shown in FIG. 17, to thereby change the range of poly Nos. FIG. 21 presents a detailed illustration of S113 in FIG. 18.

It is discriminated in S121 whether or not the UP switch 44 has been switched over. In this case, since it has already been discriminated in S108 in FIG. 18 that either the DOWN switch 43 or UP switch 44 was depressed, if the decision in S121 is NO, the DOWN switch 43 has been depressed and if the decision is YES, the UP switch 44 has been pressed.

If the DOWN switch 43 has been depressed and the decision in S121 is YES, it is discriminated in S122 whether or not the value in the register MACHINE NO. is 0. The register MACHINE NO., which will be described in detail later, is for setting a machine No. and is provided in the note No. assign control memory (see FIGS. 22A-22I) provided in the RAM 33 (FIG. 15).

The minimum value designatable as a machine No. is "1," and "0" which is less than this value by 1 is the minimum value in the register MACHINE NO. If the value in the register MACHINE NO. is "0," therefore, since the value cannot be set lower than "0," the decision in S122 becomes YES and the MACHINE NO. change process in S113 in FIG. 18 will be terminated without performing a further process. If the value in the above register is not "0," it is decremented by 1 in S123. A value attained by incrementing the value the register MACHINE NO. by 1 is displayed at P2 on the LCD 39 in FIG. 19.

If the UP switch 44 has been depressed and the decision in S121 is NO, it is discriminated in S124 whether or not the value of the register MACHINE NO. is equal to or greater than 7. The maximum value designatable as a machine No. is "8," and "7" which is less than this value by 1 is the maximum value in the register MACHINE NO. If the value in the register MACHINE NO. is "7," therefore, since the value cannot be set higher than "7," the decision in S124 becomes YES and the MACHINE NO. change process in S113 in FIG. 18 will be terminated without performing a further process. If the value in the above register is equal to or less than "6," it is incremented by 1 in S125. A value attained by incrementing the value the register MACHINE NO. by 1 is displayed at P2 on the LCD 39 in FIG. 19.

After execution of the process in S123 or S125, the flow advances to S126 where a value 8 times the changed value of the register MACHINE NO. is saved in the JOB RANGE LOWER pointer and a value attained by adding 7 to the saved value is saved in the JOB RANGE UPPER pointer. In this case, the JOB RANGE LOWER and JOB RANGE UPPER pointers, which will be described in detail later, are for setting the lower and upper limits of a poly No. and are provided in the note No. assign control memory (see FIGS. 22A–22I) provided in the RAM 33 (FIG. 15). The value of the register MACHINE NO. and the values of both pointers have the following relationship.

| MACHINE NO. | JOB RANGE LOWER POINTER | JOB RANGE UPPER POINTER |
|---|---|---|
| 0 | 0 | 7 |
| 1 | 8 | 15 |
| 2 | 16 | 23 |
| 3 | 24 | 31 |
| 4 | 32 | 39 |
| 5 | 40 | 47 |
| 6 | 48 | 55 |
| 7 | 56 | 63 |

Poly Nos. can be set in the sound source module by setting the machine Nos. in the above manner.

After execution of the above process, the individual pointers, etc. of the note No. assign control memory (see FIGS. 22A–22I) constituted in the RAM 33 (FIG. 15) are initialized and generation of all of musical tones being presently generated is stopped in the subsequent step S127, as in the case of S120 in FIG. 20.

Through the above processes, the MACHINE NO. change process of S113 in FIG. 18 will be terminated. The above sequence of processes is executed upon depressing of the DOWN switch 43 or UP switch 44 (FIG. 17) once. When either switch is further depressed, the sequence is executed once every time S102 is performed by repeating the loop of S102 and S103 (FIG. 16A).

As described above, when the cursor switches 41 and 42 (FIG. 17) are operated, the cursor 53 can be moved to any of P1 and P2 on the LCD 39 in FIG. 19 through the process of S111 in FIG. 18. Further, when the DOWN switch 43 or UP switch 44 is operated, with the cursor 53 being at P1, the poly synchronous ENABLE and DISABLE modes can be changed from one to the other through the DIS./ENA. change process in S116 in FIG. 18. If the cursor 53 is at P2, the machine No. can be changed through the MACHINE NO. change process in S113 and the range of poly Nos. can be changed accordingly.

The MIDI IN process in S103 (FIG. 16A) will now be described. In the following description, after the configuration of the note No. assign control memory (see FIGS. 22A–22I) is described, the detailed operation of the MIDI IN process illustrated in FIGS. 24–25B will be described using examples of the poly synchronous operation according to the MIDI IN process based on FIG. 23.

Figures 22A, 22B, 22C, 22D, 22E, 22F, 22G, 22H, 22I:
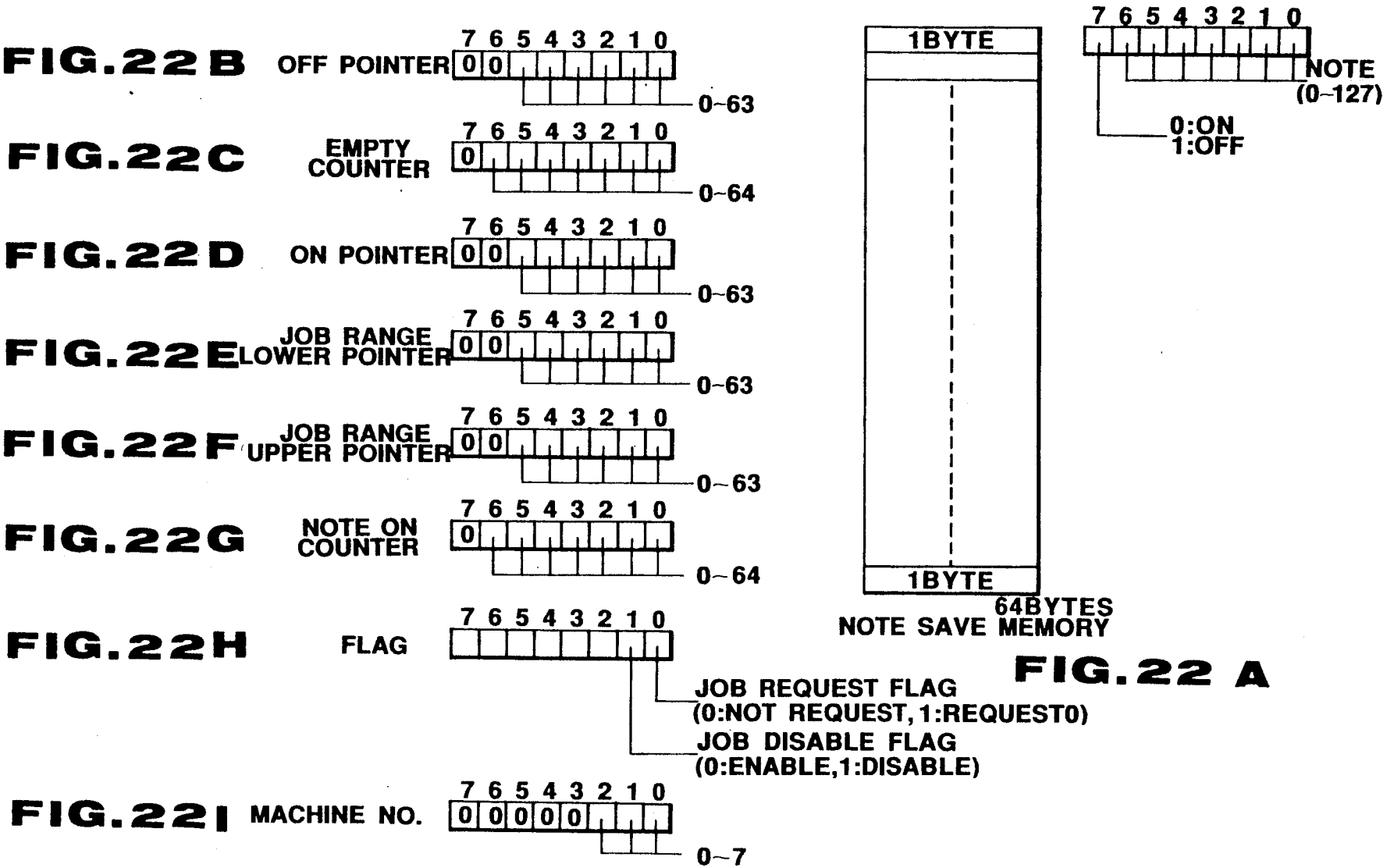
FIGS. 22A through 22I are diagrams illustrating the configuration of number-of-tone assign control memory.

FIGS. 22A–22I illustrate the configuration of the note No. assign control memory constituted in the RAM 33 (see FIG. 15). The NOTE SAVE memory in FIG. 22A has a 64-byte configuration so that up to 64 note Nos. data can be saved there; each byte corresponds to one of poly Nos. 1–64. As illustrated in FIG. 22A, the lower 7 bits of each byte represent a note No. which may take any of values 0–127, and the MSB is an ON/OFF flag. When this flag is "1," the poly No. corresponding to that byte is currently subjected to note off, and in this case, the lower 7 bits will take a value "0." Therefore, the value for one byte at the time of note off is $80_H$ (H indicating a hexadecimal notation). These will be described later.

A brief description of the pointers, counter and flag will now be given Their detailed description will be given later.

An OFF pointer in FIG. 22B holds the relative address from the head address of the NOTE SAVE memory in which the note No. subjected to note off is saved, which is the minimum value. This pointer can take any of values 0 to 63 by a combination of the lower 5 bits; a value "0" is set in the upper two bits.

An EMPTY counter in FIG. 22C holds the total number of addresses at which no note No. has been written yet after a note No. is save once in the NOTE SAVE memory and a value $80_H$ is further written after execution of note off. This pointer can take any of values 0 to 64 by a combination of the lower 6 bits; a value "0" is set in the MSB.

An ON pointer in FIG. 22D holds a value attained by adding "1" to the greatest one of the relative addresses of the note Nos. saved in the NOTE SAVE memory. This pointer can take any of values 0 to 63 by a combination of the lower 5 bits; a value "0" is set in the upper two bits.

As described earlier, the JOB RANGE LOWER pointer in FIG. 22E stores the lower limit of a poly No. which is lower by 1 than the poly No. displayed at P2 on the LCD 39 shown in FIG. 19. This pointer can take any of values 0 to 63 by a combination of the lower 5 bits; a value "0" is set in the upper two bits.

As described earlier, the JOB RANGE UPPER pointer in FIG. 22F stores the upper limit of a poly No. which is lower by 1 than the poly No. displayed at P3 on the LCD 39 shown in FIG. 19. This pointer has the same bit configuration as the JOB RANGE LOWER pointer.

A NOTE ON counter in FIG. 22G holds the total number of note Nos. saved in the NOTE SAVE memory. This pointer can take any of values 0 to 64 by a combination of the lower 6 bits; a value "0" is set in the MSB.

A flag shown in FIG. 22H is provided with a JOB REQUEST flag at the LSB and a JOB DISABLE flag at the second bit from the LSB. The JOB REQUEST flag holds data indicating whether or not a request should be made as to generate a musical tone with the note No. indicated by entered NOTE ON data. The JOB DISABLE flag is for setting either the DISABLE mode or ENABLE mode for a poly synchronous operation with respect to its sound source module.

The register MACHINE NO. in FIG. 22I is for setting a machine No. The register can take any of values 0 to 7 by a combination of the lower 3 bits; a value "0" is set in the upper 5 bits. As described earlier with reference to FIG. 21, the value of this register is converted into a value of the JOB RANGE LOWER and JOB RANGE UPPER pointers in advance before being used.

A detailed operation of the MIDI IN process according to the second embodiment using the aforementioned note No. assign control memory will now be described along the operation flowcharts shown in FIGS. 24 to 26.

Figure 24:
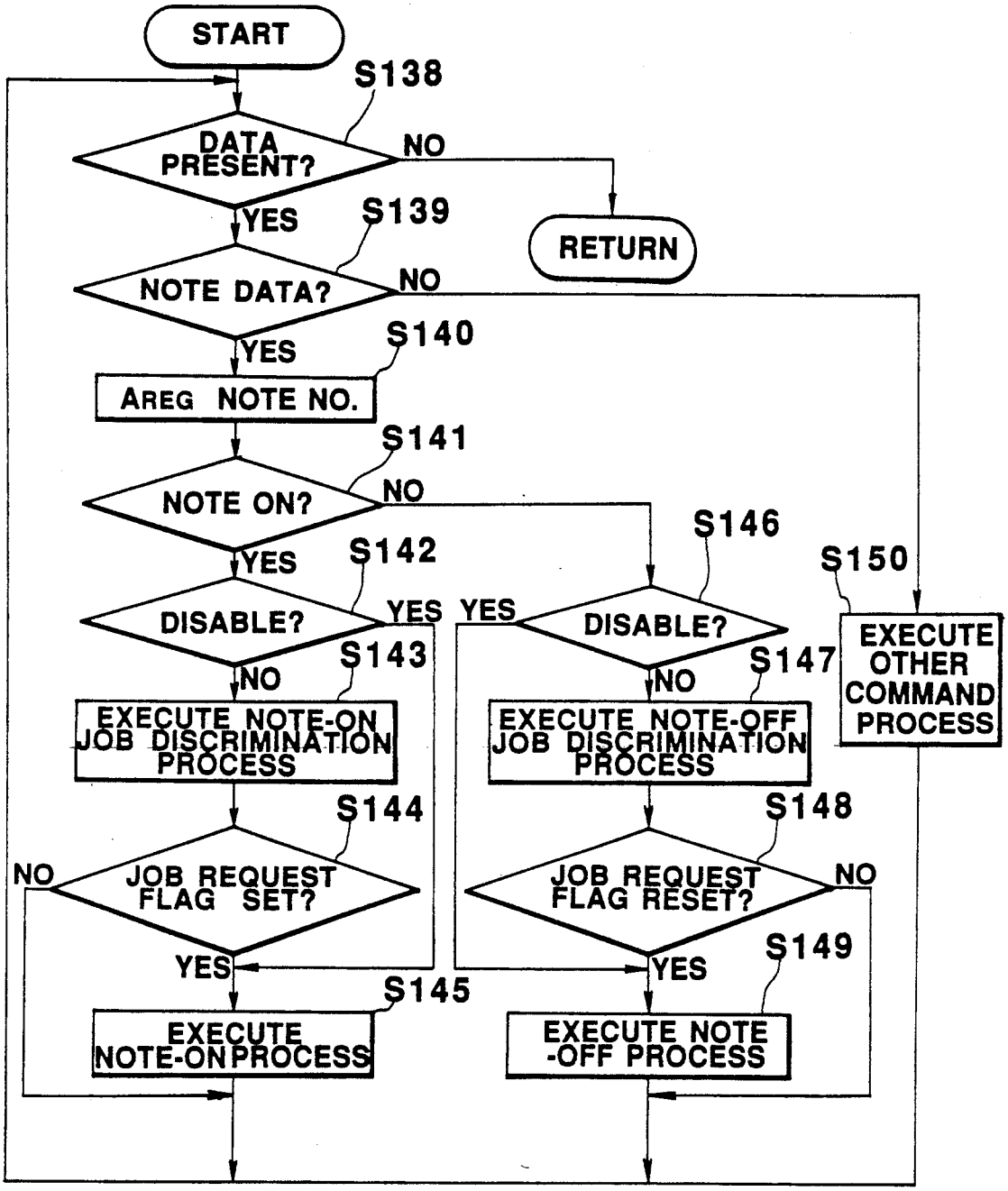
FIG. 24 is an operation flowchart for a MIDI IN process.

FIG. 24 is a detailed operation flowchart for the MIDI IN process in S103 in FIG. 16A.

First, in S138 the CPU 34 in FIG. 15 checks if MIDI data is input via the external input interface circuit 31. If the data has not been input, the decision in S138 is NO so that the MIDI IN process in S103 in FIG. 16A is immediately terminated and S103 is repeated again through the switch change process of S102. Accordingly, a status of being ready for input of MIDI data is maintained by repetitively executing S138.

When MIDI data is input and the decision in S138 becomes YES, the flow advances to S139 where it is discriminated whether the MIDI data is NOTE ON data or NOTE OFF data. If the decision is NO, the flow advances to S150 where a process other than note on and note off is executed, then S138 is repeated.

When NOTE ON data or NOTE OFF data is input and the decision in S139 becomes YES, the flow advances to S140 where a note No. included in that data is loaded into the register $A_{REG}$ in the CPU 34.

In the subsequent step S141, it is discriminated whether the input MIDI data is NOTE ON data or NOTE OFF data. When NOTE ON data is input and the decision in S141 becomes YES, the flow advances to S142 where it is discriminated whether the mode is the poly synchronous ENABLE mode or DISABLE mode.

In case of the DISABLE mode (when the display at P1 in FIG. 19 is "OFF"), the decision in S142 becomes YES and the flow advances to S145 where a NOTE ON process is executed in accordance with the note No. set in the register AREG. Then, the flow returns to S138. That is, the operation in this case is an ordinary tone generating operation of the sound source module, so that the CPU 34 (FIG. 15) gives an instruction to the sound source circuit 36 to generate a musical tone without any condition at the pitch corresponding to the note No. of the NOTE ON data.

In case of the ENABLE mode (when the display at P1 in FIG. 19 is "ON"), the decision in S142 becomes NO and the flow advances to S143 where the NOTE ON JOB discrimination process is executed. This process is one of the most important characteristics of this embodiment. In this process it is determined whether or not the NOTE ON process should be executed, and if the process should be executed, the JOB REQUEST flag in the note No. assign control memory in FIG. 22H is set to 1 and if not, the flag is reset to 0. A detailed description of the NOTE ON JOB discrimination process will be given later.

If the JOB REQUEST flag is set to 1 through the above process, the decision in S144 becomes YES and the flow advances to S145 where the NOTE ON process is executed. If the flag is reset to 0, the decision in S144 becomes NO and the flow returns to S138 without executing the NOTE ON process.

When NOTE OFF data is input and the decision in S141 becomes NO, on the other hand, the flow advances to S146 where the same discrimination as done in S142 is made.

In case of the DISABLE mode, the decision in S146 becomes YES and the flow advances to S149 where a NOTE OFF process is executed in accordance with the note No. set in the register $A_{REG}$. Then, the flow returns to S138. That is, the operation in this case is an ordinary note off operation of the sound source module, so that the CPU 34 (FIG. 15) gives an instruction to the sound source circuit 36 to stop generating a presently-generated musical tone corresponding to the note No. of the NOTE OFF data, without any condition.

In case of the ENABLE mode, the decision in S146 becomes NO and the flow advances to S147 where the NOTE OFF JOB discrimination process is executed. This process, like the NOTE ON JOB discrimination process, is also the most important characteristic of the second embodiment. In this process it is determined whether or not the NOTE OFF process should be executed, and if the process should be executed, the JOB REQUEST flag is set to 1 and if not, the flag is reset to 0. A detailed description of the NOTE OFF JOB discrimination process will be given later.

If the JOB REQUEST flag is set to 1 through the above process, the decision in S148 becomes YES and the flow advances to S149 where the NOTE OFF process is executed. If the flag is reset to 0, the decision in S148 becomes NO and the flow returns to S138 without executing the NOTE OFF process.

Figure 25B:
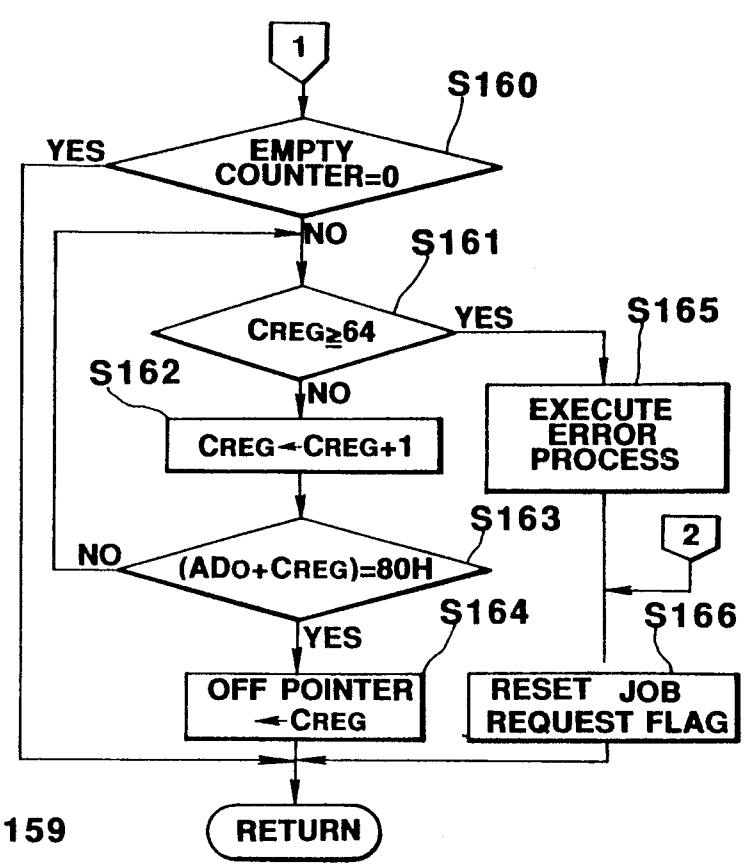
FIGS. 25A and 25B illustrate an operation flowchart for a NOTE ON JOB discrimination process.

The operation flowcharts of FIGS. 25A and 25B associated with the NOTE ON JOB discrimination process in S143 in FIG. 24 and those of FIGS. 26A and 26B associated with the NOTE OFF JOB discrimination process in S147 will now be explained according to the operational examples illustrated in FIG. 23.

The foregoing description of this embodiment has been given with reference to a single sound source module. Assume that in that sound source module, machine No.=2, i.e., poly Nos. 9 to 16 are specified through the switch change process in SI02 in FIG. 16A, as shown in FIG. 19. With the note No. assign control memory being initialized in S101 in FIG. 16A, S120 in FIG. 20 or S136 in FIG. 23, as shown in FIG. 23(*a*), ON pointer=0
JOB RANGE LOWER pointer=8
JOB RANGE UPPER pointer=15
EMPTY counter=0
NOTE ON counter=0

OFF pointer=unsettled.

In this initialized state, the content of the NOTE SAVE memory is not settled.

When a keyboard or the like coupled externally to the sound source module is played and NOTE ON data with note Nos. $20_H$ to $34_H$ for 21 notes are sequentially input to the CPU 34 through the external input interface circuit 31 (FIG. 15), the value of the ON pointer is changed to 21 from 0, so is the value of the NOTE ON counter, as shown in FIG. 23(*b*). Accordingly, the individual note Nos. $20_H$–$34_H$ are saved at the sequential relative address 0 to 20 starting from the head address in the NOTE SAVE memory. The value of the OFF pointer is unsettled. In this case, in the state shown in FIG. 23(*b*), the CPU 34 issues an tone generation instruction to the sound source circuit 36 only with respect to the note Nos. saved at the relative addresses 8–15 associated with the poly Nos. designated by the JOB RANGE LOWER pointer and JOB RANGE UPPER pointer. Accordingly, this sound source module generates 8 polyphonic tones corresponding to the poly Nos. 9–16.

The operation in the state shown in FIG. 23(*b*) is realized as follows.

First, the MIDI IN process of S103 in FIG. 16A is repeated once every time one piece of NOTE ON data is input. Each time the process is repeated, the sequence of processes, S138→S139→S140→S141→S142→S143, is executed to enter the NOTE ON JOB discrimination process as illustrated in FIG. 25.

Figure 25A:
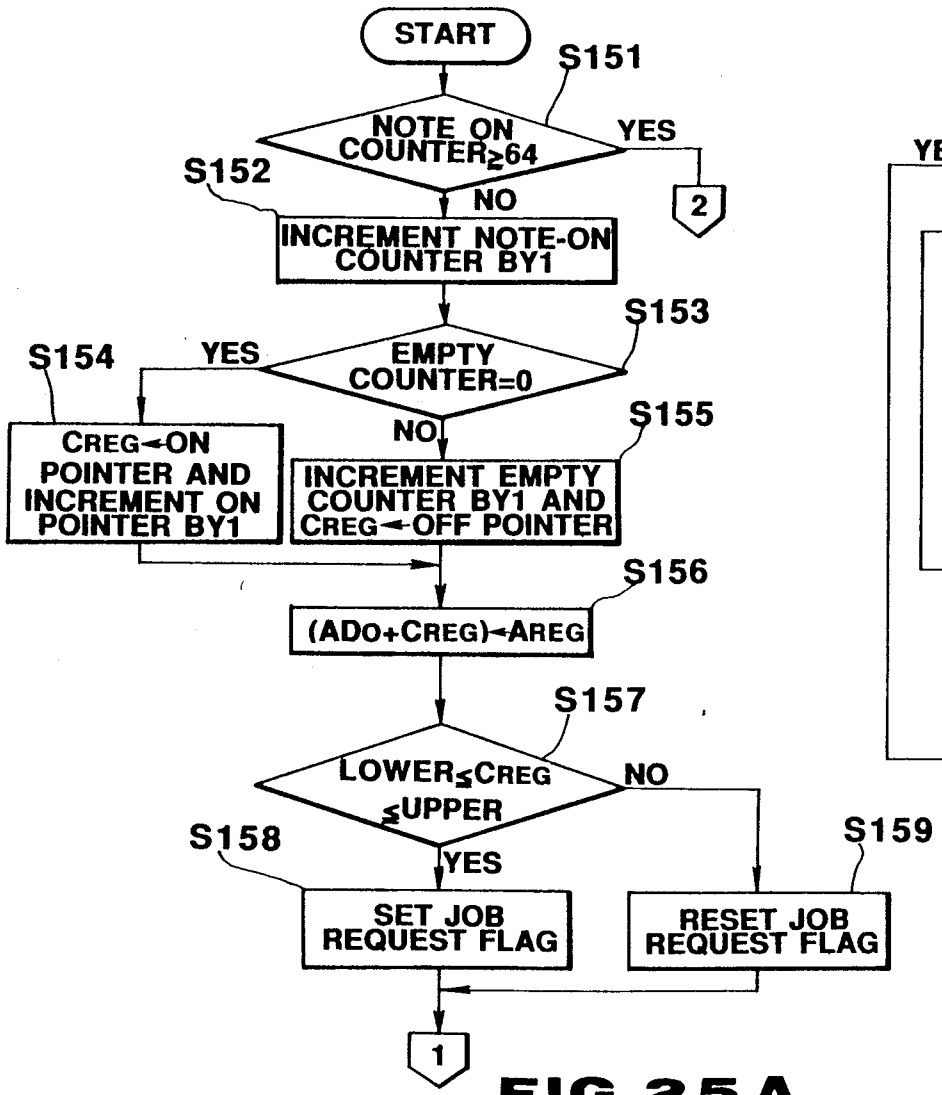

In S151 in FIG. 25A, it is discriminated whether or not the value of the NOTE ON counter is equal to or greater than 64. If the value is equal to or greater than 64, the flow advances to S166 where the JOB REQUEST flag is reset and the NOTE ON JOB discrimination process of S143 in FIG. 24 will be terminated. In other words, the process of S151 is a discrimination process for not permitting generation of beyond the 65th tone since the maximum number of polyphonic tones or the maximum number of simultaneous generatable tones is 64 in this embodiment. When the JOB REQUEST flag is reset to 0, the decision in S144 becomes NO and the NOTE ON process will not be further executed. In the example of FIG. 23(*b*), in the initialized state, the value of the NOTE ON counter is equal to or less than 63, so that the decision in S151 becomes YES and the flow advances to S152.

In S152 the value of the NOTE ON counter is incremented by 1. In the example of FIG. 23(*b*), the value of the NOTE ON counter is changed from 0 to 21 by repeating the process of S152 every time each note No. is input.

Figure 23:
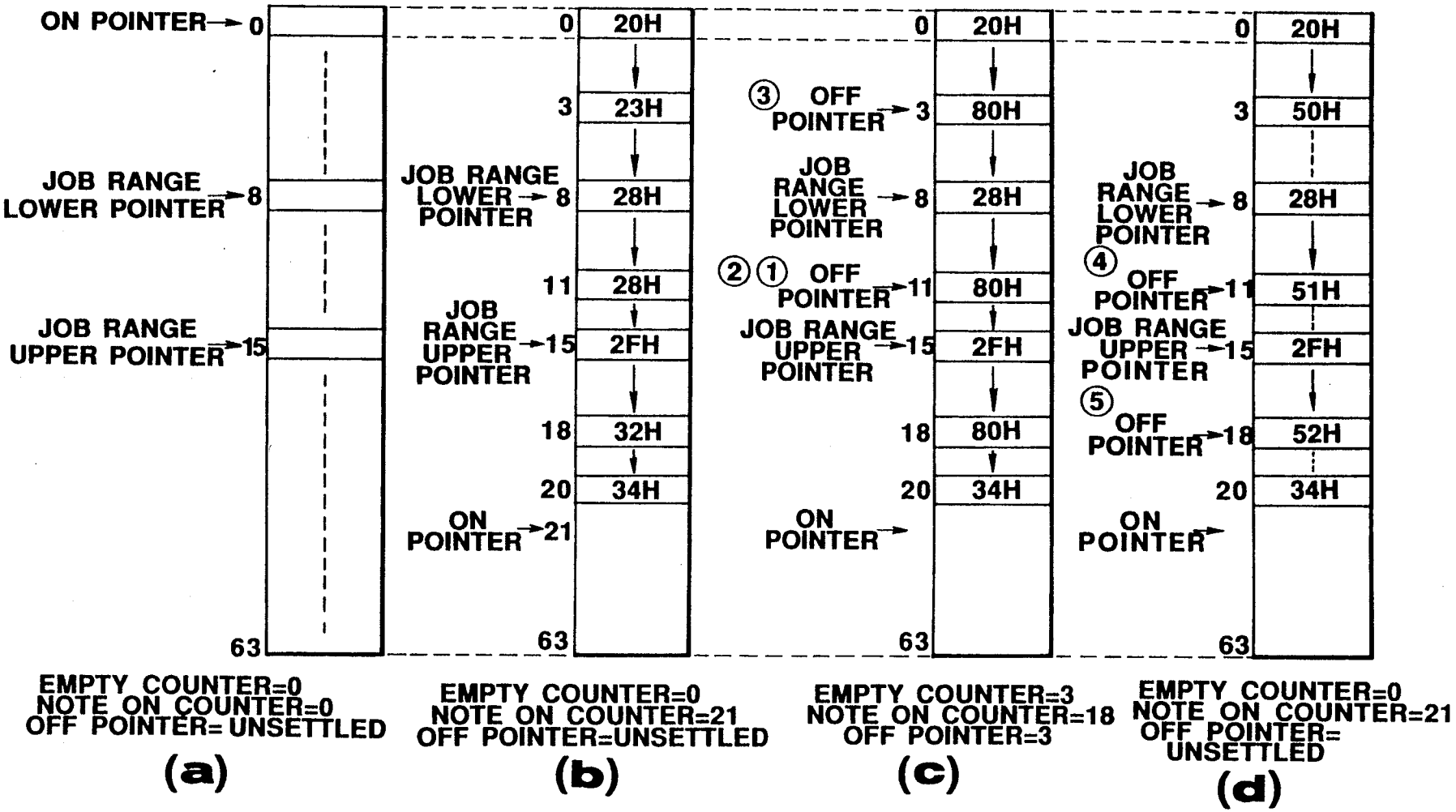
FIGS. 23 is a diagram showing examples of a poly synchronous operation.

In S153 it is discriminated whether or not the value of the EMPTY counter is "0." As it is "0" in the example of FIG. 23(*b*), the flow advances to S154.

In this step, after the value of the ON pointer is loaded into the register $C_{REG}$ in the CPU 34 shown in FIG. 15, the value of the ON pointer is incremented by 1. That is, since the ON pointer holds a value attained by adding "1" to the greatest one of the relative addresses of the note Nos. saved in the NOTE SAVE memory, as described earlier with reference to FIG. 22D, the relative address at which the present note No. should be saved is set in the register $C_{REG}$ by repeating the process of S154 every time each note No. is input. In the example of FIG. 23(*b*), the value of ON pointer is changed from 0 to 21.

In S156, the head address (absolute address) $AD_0$ of the NOTE SAVE memory as shown in FIG. 22A is added with the relative address set in the register $C_{REG}$ to compute the absolute address corresponding to this relative address, and the note No. set in the register $A_{REG}$ in S140 in FIG. 24 is saved at that address. By repeating this process of S154 every time each note No. is input, the individual note Nos. $20_H$–$34_H$ are saved at the sequential relative addresses 0–20 starting from the head address in the NOTE SAVE memory in the case of FIG. 23(*b*).

In S157, it is discriminated whether or not the relative address set in the register $C_{REG}$ falls within the range determined by the values of the JOB RANGE LOWER pointer and JOB RANGE UPPER pointer. If the address falls in this range, the JOB REQUEST flag is set to 1 in S158 and if not, the flag is reset to 0 in S159. By repeating the decision in S157 when each note No. is input, the JOB REQUEST flag is set to 1 only for those note Nos. saved at the relative addresses 8–15 and the flag is reset to 0 otherwise in the case of FIG. 23(*b*).

In the subsequent step S160, it is discriminated whether or not the value of the EMPTY counter is "0." As it is "0" in the case of FIG. 23(*b*), the decision there is YES and the NOTE ON JOB discrimination process of S143 in FIG. 24 will be terminated.

The decision in S144 in FIG. 24 becomes YES only when the JOB REQUEST flag is set to 1, and the flow advances to S145 where the NOTE ON process is executed. By repeating the discrimination process of S144 every time each note No. is input, as described above, a tone generation instruction is issue to the sound source circuit 36 (FIG. 15) only for those note Nos. saved at the relative addresses 8–15 in the case of FIG. 23(*b*).

Returning to FIG. 23, when keys on an external keyboard or the like corresponding to the individual note Nos. $2B_H$, $32_H$ and $23_H$ are released in the state of (b) in the same diagram and the NOTE OFF data associated with these note Nos. are input in the named order, $80_H$ indicating note off in progress is stored at the relative address 11, 18 and 3 where the note Nos. $2b_H$, $32_H$ and $23_H$ have been stored. At the same time, the value (relative address) of the OFF pointer is changed in the sequence of unsettled→11→11→3 ((1)→(2)→(3) in FIG. 23(*c*)). In the process of (2), since the relative address 18 where the note No.=$32_H$ has been stored is greater than the relative address 11 where the note No.=$2B_H$ has been stored, the value of the OFF pointer is not changed to 18. The values of the EMPTY counter changes in the sequence of 0→1→2→3, and the value of the NOTE ON counter changes in the sequence of 21→20→19→18. The value of the ON pointer does not change. In this case, only for the relative address 11 among the relative addresses 8–15 indicated by the JOB RANGE LOWER pointer and JOB RANGE UPPER pointer where the note No.=$2B_H$ has been stored and is replaced by a value $80_H$, the CPU 34 (FIG. 15) issues a note off instruction to the sound source circuit 36 shown in FIG. 15 to stop generating a musical tone having that note No. in the state of FIG. 23(*c*).

The operation in the state shown in FIG. 23(*c*) is realized as follows.

First, the MIDI IN process of S103 in FIG. 16A is repeated once every time one piece of NOTE OFF data is input. Each time the process is repeated, the sequence of processes, S138→S139→S140→S141→S146→S147 (see FIG. 24), is executed to enter the NOTE OFF JOB discrimination process as illustrated in FIGS. 26A and 26B.

Figure 26A:
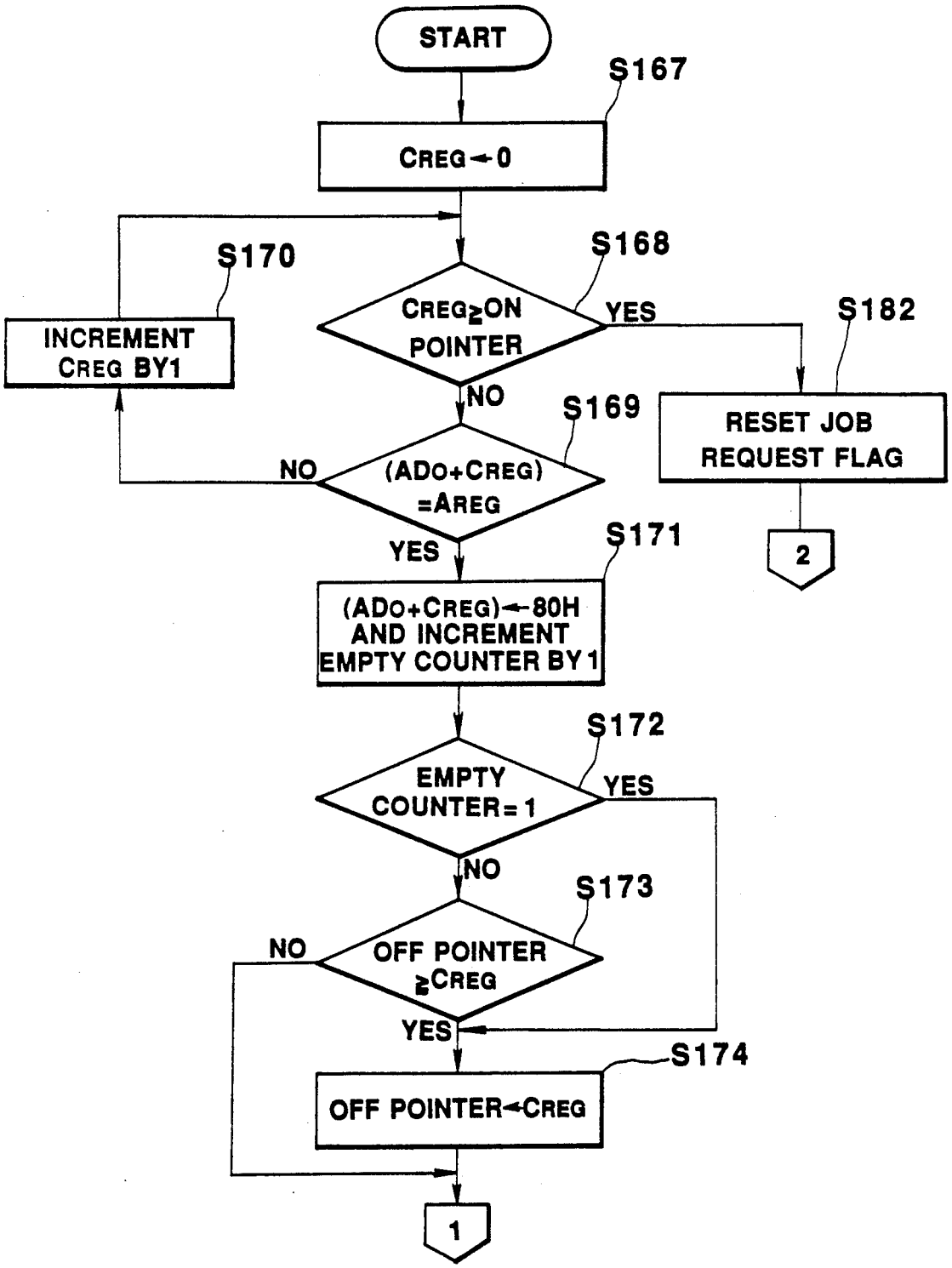
FIGS. 26A and 26B illustrate an operation flowchart for a NOTE OFF JOB discrimination process.

In S167 in FIG. 26A, "0" is set in the register $C_{REG}$, and while incrementing the value of the register $C_{REG}$ by 1 in S170 in the loop of S168→S169→S170→S168, the note Nos. to be subjected to note off is compared with the content of the NOTE SAVE memory at the address ($AD_0+C_{REG}$) to find the one which coincides with the memory content. In S168 it is discriminated whether or not the relative address indicated by the $C_{REG}$ has reached the value of the ON pointer beyond which no note Nos. exist in the NOTE SAVE memory. If the relative address reaches this value, the decision in S168 becomes YES, the JOB REQUEST flag is reset to 0 in S182 and the NOTE OFF JOB discrimination process of S147 in FIG. 24 will be terminated. In this case, therefore, corresponding note Nos. do not exist any more in the NOTE SAVE memory and the decision in S148 in FIG. 24 becomes NO so that the NOTE OFF process in S149 will not be executed. By repeating the loop of S168→S169→S170→S168 in FIG. 26A, the relative addresses 11, 18 and 3 where the note Nos. $2B_H$, $32_H$ and $23_H$ that should be subjected to note off have been stored, are retrieved in the example of FIG. 23(*c*).

Every time the relative address whose content coincides with a note No. to be subjected to note off is retrieved, the decision in S169 becomes YES and the flow advances to S171. In this step the value $80_H$ indicating note off in progress is stored at the retrieved address ($AD_0+C_{REG}$) and the value of the EMPTY counter is incremented by 1. By repeating the process of S171 every time each note No. is input, the value $80_H$ indicating the note off in progress is stored at the relative addresses 11, 18 and 3 and the value of the EMPTY counter is changed in the sequence of 0→1→2→3 at the same time in the example of FIG. 23(*c*).

In the subsequent step S172 it is discriminated whether or not the value of the EMPTY counter is 1. If the value is 1, the value of the register $C_{REG}$ is saved in the OFF pointer in S174. This process is executed when the relative address 11 associated with the first note No.$=2B_H$ is retrieved and the value of the OFF pointer is changed from an "unsettled" state to 11 in the example of FIG. 23(*c*).

If the decision in S172 is NO, the value of the OFF pointer is compared with the value of the register CREG in S173. If the value of the register $C_{REG}$ is greater, the value of the OFF pointer is not changed. This process is executed when the relative address 18 associated with the second note No.$=32_H$ is retrieved and the value of the OFF pointer is left unchanged at 11 in the example of FIG. 23(*c*).

If the value of the register $C_{REG}$ is smaller than the value of the OFF pointer, on the other hand, the value of the register $C_{REG}$ is saved in the OFF pointer. This process is executed when the relative address 3 associated with the third note No.$=23_H$ is retrieved and the value of the OFF pointer is changed from 11 to 3 in the example of FIG. 23(*c*).

Through the processes of S172-S174, the OFF pointer holds the smallest one of the relative addresses where the value $80_H$ indicating the note off in progress is stored.

In S175, it is discriminated whether or not the relative address set in the register $C_{REG}$ falls within the range determined by the values of the JOB RANGE LOWER pointer and JOB RANGE UPPER pointer. If the address falls in this range, the JOB REQUEST flag is set to 1 in S176 and if not, the flag is reset to 0 in S177. By repeating the decision in S175 when each note No. is input, the JOB REQUEST flag is set to 1 only for the relative address 11 among the relative address 8-15 where the note No.$=2B_H$ has been stored but is replaced by the value $80_H$, and the flag is reset to 0 otherwise in the case of FIG. 23(*c*).

In the subsequent step S178, the value of the register $C_{REG}$ is incremented by 1. The values of this register is compared with the value of the ON pointer in S179. If the former value is equal to or greater than the latter one, the value of the ON pointer is decremented by 1 in S180. Through these processes, when the note No. whose associated relative address is the greatest is subjected to note off, the value of the ON pointer is set to the relative address whose note No. has been subjected to note off. The decision in S179 is always NO in the example of FIG. 23(*c*), and the value of the ON pointer does not change.

Finally, in S181, the value of the NOTE ON counter is decremented by 1 and the NOTE OFF JOB discrimination process of S147 in FIG. 24 will be terminated. By repeating the process of S181 every time each note No. is input, the value of the NOTE ON counter changes in the sequence of 21→20→19→18 in the example of FIG. 23(*c*).

Figure 26B:
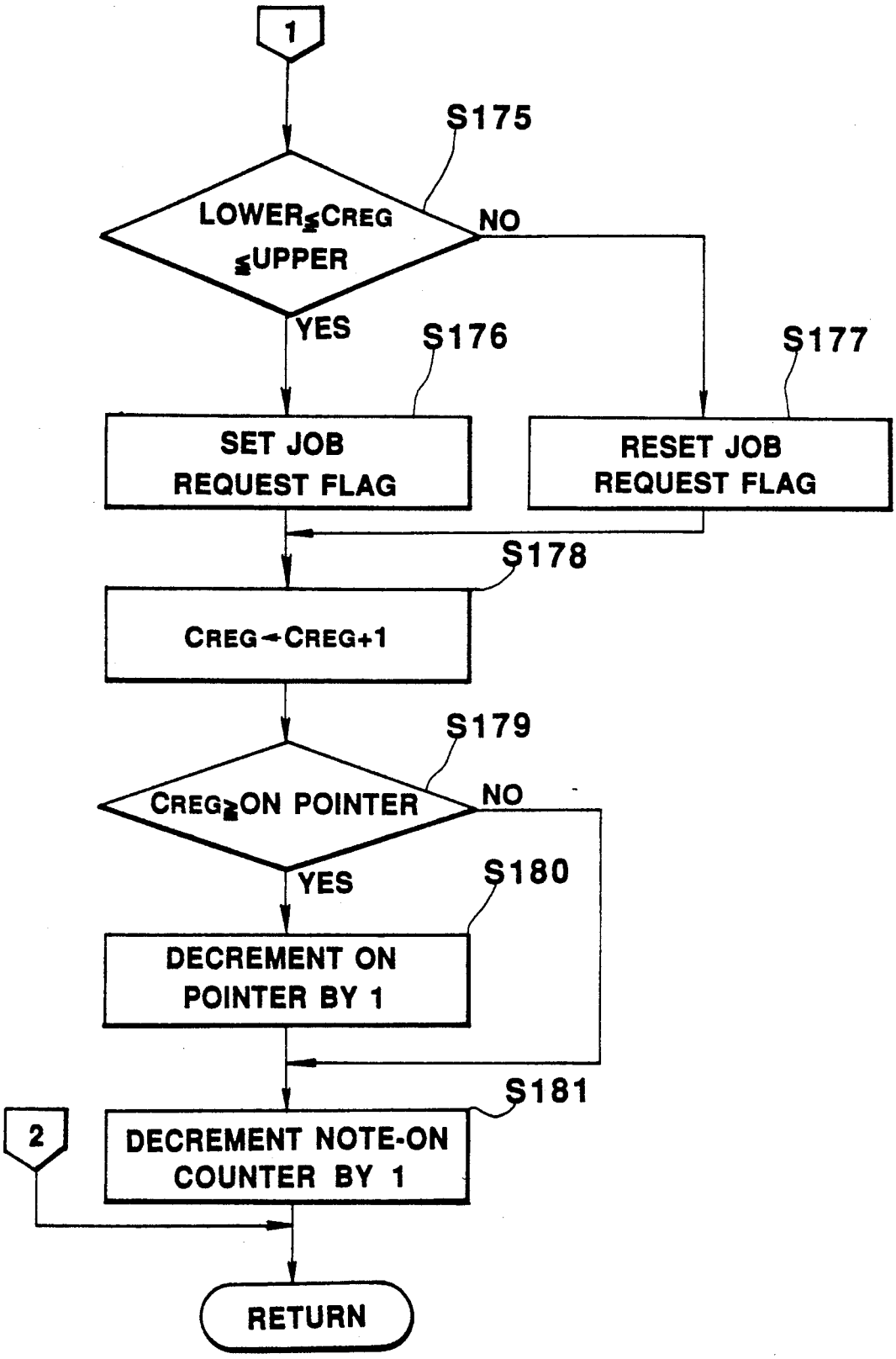

If and only if, after execution of the above processes, "1" is set in the JOB REQUEST flag in S176 in FIG. 26B, the decision in S148 in FIG. 24 becomes YES and the flow advances to S149 where the NOTE OFF process is executed. By repeating the discrimination process of S148 every time each note No. is input, a note off instruction is given to the sound source circuit 36 shown in FIG. 15 only for the relative address 11 among the relative addresses 8-15 where the note No.$=2B_H$ has been stored but is replaced with the value $80_H$ in the example of FIG. 23(*c*).

Returning again to FIG. 23, assume that in the state of (*c*) in this diagram, a new key depression on the external keyboard or the like is performed and NOTE ON data corresponding to note Nos. $50_H$, $51_H$ and $52_H$ are sequentially input.

First, when the NOTE ON data of the note No.$=50_H$ is input, $50_H$ is written at the relative address 3 indicated by the OFF pointer and the value of the OFF pointer is changed to smallest relative address 11 at which the value $80_H$ indicating the note off in progress is stored. The value of the EMPTY counter is decremented by 1 to be changed to 2 from 3, and the value of the NOTE ON counter is incremented by 1 to be changed to 19 from 18. When the NOTE ON data of the note No.$=51_H$ is input, $51_H$ is written at the relative address 11 indicated by the OFF pointer and the value of the OFF pointer is changed to relative address 18. The value of the EMPTY counter is changed to 1 from 2, and the value of the NOTE ON counter is changed to 20 from 19. Further, when the NOTE ON data of the note No.$=52_H$ is input, $52_H$ is written at the relative address 18 indicated by the OFF pointer and the value of the OFF pointer becomes unsettled. The value of the EMPTY counter is changed to 0 from 1, and the value of the NOTE ON counter is changed to 20 from 21. In other words, through the above operation, the value of the OFF pointer changes from the state (3) in FIG. 23(*c*) to (4) and (5) in FIG. 23(*d*). In this case, the CPU 34 issues a tone generation instruction to the sound source circuit 36 only for the note No. $51_H$ saved at the relative address 11 included in the relative addresses 8–15 associated with the poly Nos. indicated by the JOB RANGE LOWER pointer and JOB RANGE UPPER pointer in the state of FIG. 23(*d*).

The operation in the state transition from (c) to (d) in FIG. 23 is realized as follows.

First, the MIDI IN process of S103 in FIG. 16A is repeated once every time one piece of NOTE ON data is input. Each time the process is repeated, the sequence of processes, S138→S139→S140→S141→S142→S143, is executed to enter the NOTE ON JOB discrimination process as illustrated in FIGS. 13A and 13B, as in the case of FIG. 23(*b*).

When the NOTE ON data of the note No.=$50_H$ is input in the state of FIG. 23(*c*), the decision in S151 becomes NO and the value of the NOTE ON counter is changed to 19 from 18 in S152.

Then, the decision in S153 is NO since the present value of the EMPTY counter is 3 (state of FIG. 23(*c*)), and the flow advances to S155. In S155 the value of the EMPTY counter is decremented by 1 to be changed to 2 from 3, and the value of the OFF pointer is loaded into the register $C_{REG}$.

In the subsequent step S156, the note No. stored in the register $A_{REG}$ is saved at an address attained by adding the relative address of the register $C_{REG}$ to the head address $AD_0$. In the example of transition from FIG. 23(*c*) to FIG. 23(*d*), when the note No.=$50_H$ is input, $50_H$ is written at the relative address 3.

The processes associated with the JOB REQUEST flag in S157–S159 are exactly the same as those in the case of FIG. 23(*b*); with the note No.=$50_H$, the value '3" of the register $C_{REG}$ does not satisfy the conditions of S157, and the JOB REQUEST flag is reset to 0 in S159

Then, the decision in S160 is NO since the present value of the EMPTY counter is 2, and the flow advances to S161.

The loop of S161→S162→S163→S161 is a process for moving the OFF pointer to the youngest relative address at which $80_H$ indicating the tone off in progress is stored since a new note No. is saved at the relative address which has been indicated by the OFF pointer. In other words, while incrementing the value of the register $C_{REG}$ by 1 in S162, the content of the address ($AD_0+C_{REG}$) is compared with $80_H$ indicating the tone off in progress to check if they coincide with each other in S163. In S161 it is discriminated whether or not the range of the above retrieval exceeds the upper limit 63 of the relative address in the NOTE SAVE memory. If the value of the EMPTY counter is not 0, there should be one other relative address which indicates the tone off in progress, so that the decision in S161 cannot become YES. If it becomes YES for some reasons, however, the flow advances to S165 where the proper error process is executed. Then, the JOB REQUEST flag is reset to 0 in S166. That is, in this case, the decision in S144 in FIG. 24 (which will be described later) becomes NO and no note off operation is executed.

If the decision is YES in S163 and the relative address indicating the note off in progress is found, the value of the register $C_{REG}$ indicating it is saved in the OFF pointer in S164. As a result, when the note No.=$50_H$ is input in the example of (c)→(d) in FIG. 23, the value of the OFF pointer is changed to 11 from 3.

Through the above processes, the NOTE ON JOB discrimination process of S143 in FIG. 24 is completed.

After execution of the above operation, the value of the JOB REQUEST flag is discriminated in S144. When the note No.=$50_H$ is input in the example of (c)→(d)in FIG. 23, since the JOB REQUEST flag is reset to 0 as described earlier, the decision in S144 becomes NO and the NOTE ON process will not be executed.

When the other note Nos. $51_H$ and $52_H$ are input, the same operation will be performed as in the case of (c)→(d) in FIG. 23.

As described above, the sound source module has the NOTE SAVE memory for storing data of the status associated with the poly Nos. assigned to this module as well as the poly Nos. assigned to all the other sound source modules, and the content of this memory is updated every time the NOTE ON data and NOTE OFF data are input. When a plurality of sound source modules are mutually connected, this operation will be executed for each sound source module in synchronism with the other modules. This is because the NOTE ON data and NOTE OFF data are input to all the sound source modules in parallel and each sound source module updates the content of its own NOTE SAVE memory according to the same rule. Further, each sound source module performs a tone generating operation only when the note No. based on an NOTE ON instruction is set within the range of poly Nos. based on a machine No. set to this module, and performs a note off operation only when a NOTE OFF instruction is given with respect to the note Nos. set within the range. Accordingly, each sound source module can executes an polyphonic operation separately. Since poly Nos. need not be directly specified for each sound source module but they are automatically designated for every 8 polyphonic channels by setting a machine No., the player can properly set the poly Nos. with an easy operation.

The sound source module may be equipped with keys.

According to the second embodiment, when a plurality of sound source modules are mutually connected and are operated simultaneously, the contents of the note data memory means of the individual sound source modules are updated fully in accordance with the same rule, and each module executes tone generation control dealing with only the polyphonic channels in the second polyphonic region which are designated for this module. Accordingly, the connected sound source modules as a whole can function as if tone generation is executed by a single sound source module, and it is possible to expand the number of polyphonic channels in accordance with the number of sound source modules connected.

Particularly, the polyphonic region designating means of each sound source module can easily set the second polyphonic region by specifying a machine No., so that quick setting of the second polyphonic region is possible even during a musical performance.

Although the polyphonic channel region to be subjected to tone control is designed by a user for each sound source module in the first and second embodiments, a design modification may be made in such a way that the polyphonic channel region is automatically determined when a power switch, for example, is thrown ON after a plurality of sound source modules are mutually connected. The individual sound source modules (having the same performance) are connected in such a way that a main sound source module is determined in advance and the other sound source modules are connected to a plurality of terminals of the main sound source module from which note data are output.

The above arrangement can eliminate the need to designate the polyphonic channel region for each sound source module.

What is claimed is:

1. A sound source apparatus capable of receiving note data from an external unit and executing tone control based on said note data, said apparatus comprising:

polyphonic region designating means for specifying, in a first polyphonic region having a plurality of polyphonic channels, a second polyphonic region included in said first polyphonic region, by specifying upper and lower limit channels thereof;

note data memory means for storing note data for each polyphonic channel in said first polyphonic region, in an associated area;

polyphonic channel control means for, when receiving note data, updating note data of said polyphonic channels in said first polyphonic region, stored in said note data memory means, in accordance with a predetermined rule; and tone control means having tone generation control means for controlling generation of a musical tone based on note data of each polyphonic channel stored in those areas of said note data memory means which are associated with said second polyphonic region.

2. A sound source apparatus according to claim 1, wherein said tone control means includes means for selecting between a first mode for performing tone generation control based on note data of each polyphonic channel stored in said second polyphonic region in said note data memory means and a second mode for performing tone generation control based on said received note data without using said second polyphonic region in said note data memory means, and means for enabling said tone generation control means in response to a selection of said first mode by said selecting means and for disabling said tone generation control means in response to a selection of said second mode by said selecting means.

3. A sound source apparatus capable of receiving note data from an external unit and executing tone control based on said note data, said apparatus comprising:

polyphonic region designating means for specifying, in a first polyphonic region having a plurality of polyphonic channels, a second polyphonic region included in said first polyphonic region, by specifying a machine number of said sound source apparatus;

note data memory means for storing note data for each polyphonic channel in said first polyphonic region, in an associated area;

polyphonic channel control means having tone generation control means for, when receiving note data, updating note data of said polyphonic channels in said first polyphonic region, stored in said note data memory means, in accordance with a predetermined rule; and tone control means for controlling generation of a musical tone based on note data of each polyphonic channel stored in those areas of said note data memory means which are associated with said second polyphonic region.

4. A sound source apparatus according to claim 3, wherein said tone control means includes means for selecting between a first mode for performing tone generation control based on note data of each polyphonic channel stored in said second polyphonic region in said note data memory means and a second mode for performing tone generation control based on said received note data without using said second polyphonic region in said note data memory means, and means for enabling said tone generation control means in response to a selection of said first mode by said selecting means and for disabling said tone generation control means in response to a selection of said second mode by said selecting means.

5. A sound source apparatus having a plurality of keys and capable of executing tone control based on note data attained by depressing of said keys and note data supplied from an external unit, said apparatus comprising:

polyphonic region designating means for specifying, in a first polyphonic region having a plurality of polyphonic channels, a second polyphonic region included in said first polyphonic region, by specifying upper and lower limit channel thereof;

note data memory means for storing said note data for each polyphonic channel in said first polyphonic region, in an associated area;

polyphonic channel control means for, when said note data is input, updating note data of said polyphonic channels in said first polyphonic region, stored in said note data memory means, in accordance with a predetermined rule;, and tone control means having tone generation control means for controlling generation of a musical tone based on said note data of each polyphonic channel stored in those areas of said note data memory means which are associated with said second polyphonic region.

6. A sound source apparatus according to claim 5, wherein said tone control means includes means for selecting between a first mode for performing tone generation control based on note data of each polyphonic channel stored in said second polyphonic region in said note data memory means and a second mode for performing tone generation control based on said received note data without using said second polyphonic region in said note data memory means, and means for enabling said tone generation control means in response to a selection of said first mode by said selecting means and for disabling said tone generation control means in response to a selection of said second mode by said selecting means.

7. A sound source apparatus having a plurality of keys and capable of executing tone control based on note data attained by depressing of said keys and note data supplied from an external unit, said apparatus comprising:

polyphonic region designating means for specifying, in a first polyphonic region having a plurality of polyphonic channels, a second polyphonic region included in said first polyphonic region, by specifying a machine number of said sound source apparatus;

note data memory means for storing note data for each polyphonic channel in said first polyphonic region, in an associated area;

polyphonic channel control means for, when note data is input, updating note data of said polyphonic channels in said first polyphonic region, stored in said note data memory means, in accordance with a predetermined rule; and tone control means having tone generation control means for controlling generation of a musical tone based on note data of each polyphonic channel stored in those areas of said note data memory means which are associated with said second polyphonic region.

8. A sound source apparatus according to claim 7, wherein said tone control means includes means for selecting between a first mode for performing tone generation control based on note data of each polyphonic channel stored in said second polyphonic region in said note data memory means and a second mode for performing tone generation control based on said received note data without using said second polyphonic region in said note data memory means, and means for enabling said tone generation control means in response to a selection of said first mode by said selecting means and for disabling said tone generation control means in response to a selection of said second mode performed by said selecting means.

9. A sound source apparatus capable of being connected to other sound source apparatuses of the same type and each capable receiving note data from an external unit and executing tone control based on said note data, said apparatus comprising:

polyphonic region designating means for automatically specifying, in a first polyphonic region having a plurality of polyphonic channels, a second polyphonic region included in said first polyphonic region, for each sound source apparatus;

note data memory means for storing note data for each polyphonic channel in said first polyphonic region, in an associated area;

polyphonic channel control means for, when receiving note data, updating note data of said polyphonic channels in said first polyphonic region, stored in said note data memory means, in accordance with a predetermined rule; and tone control means having tone generation control means for controlling generation of a musical tone based on note data stored in each polyphonic channel in said second polyphonic region in said note data memory means.

10. A sound source apparatus according to claim 9, wherein said tone control means includes means for selecting between a first mode for performing tone generation control based on note data of each polyphonic channel stored in said second polyphonic region in said note data memory means and a second mode for performing tone generation control based on said received note data without using said second polyphonic region in said note data memory means, and means for enabling said tone generation control means in response to a selection of said first mode by said selecting means and for disabling said tone generation control means in response to a selection of said second mode performed by said selecting means.

11. A sound source apparatus according to claim 9, wherein the number of polyphonic channels is the same for each apparatus.

12. A sound source apparatus according to claim 9, wherein said polyphonic region designating means starts functioning when said sound source apparatus is powered ON, and said second polyphonic region is automatically designated under a condition that a plurality of sound source apparatuses are mutually connected.

* * * * *